US008141381B2

(12) United States Patent
Ino et al.

(10) Patent No.: US 8,141,381 B2
(45) Date of Patent: Mar. 27, 2012

(54) VAPOR COMPRESSION REFRIGERATING CYCLE, CONTROL METHOD THEREOF, AND REFRIGERATING APPARATUS TO WHICH THE CYCLE AND THE CONTROL METHOD ARE APPLIED

(75) Inventors: Nobumi Ino, Tokyo (JP); Takayuki Kishi, Tokyo (JP)

(73) Assignee: Mayekawa Mfg. Co., Ltd. (JP)

( * ) Notice: Subject to any disclaimer, the term of this patent is extended or adjusted under 35 U.S.C. 154(b) by 679 days.

(21) Appl. No.: 12/293,809

(22) PCT Filed: Oct. 20, 2006

(86) PCT No.: PCT/JP2006/321453

§ 371 (c)(1),
(2), (4) Date: Nov. 6, 2008

(87) PCT Pub. No.: WO2007/110991

PCT Pub. Date: Oct. 4, 2007

(65) Prior Publication Data

US 2009/0183517 A1 Jul. 23, 2009

(30) Foreign Application Priority Data

Mar. 27, 2006 (JP) ..... 2006-086601

(51) Int. Cl.

| | |
|---|---|
| ***F25D 9/00*** | (2006.01) |
| ***F25B 41/00*** | (2006.01) |
| ***F25B 27/00*** | (2006.01) |
| ***F25B 13/00*** | (2006.01) |

(52) U.S. Cl. ..... 62/402; 62/113; 62/238.6; 62/324.6

(58) Field of Classification Search ..... 62/113, 62/117, 238.6, 513, 324.6, 87, 498, 402
See application file for complete search history.

(56) References Cited

U.S. PATENT DOCUMENTS

2004/0172958 A1 9/2004 Ito et al.

FOREIGN PATENT DOCUMENTS

EP 1014013 A1 6/2000

(Continued)

OTHER PUBLICATIONS

Search report issued in corresponding PCT/JP2006/321453, dated May 22, 2007.

(Continued)

*Primary Examiner* — Chen Wen Jiang
(74) *Attorney, Agent, or Firm* — Rossi, Kimms & McDowell LLP

(57) ABSTRACT

The vapor compression refrigerating apparatus of the invention comprises a compressor 2, a condenser 4, a regeneration heat exchanger 6, an expansion means 8, and an evaporator 10 connected in series. The vapor compression refrigerating cycle is based on a cycle corresponding to a reversed Ericsson cycle in which isothermal heat dissipation process and isothermal heat absorption process occur overstriding a saturated vapor line and saturated liquid line respectively and heat exchange is carried out between isobaric heat dissipation process in a liquid zone and isobaric heat absorption process in a superheated vapor zone. A process part occurring in a superheated vapor zone of the isothermal heat dissipation process (an isothermal compression process) is substituted by adiabatic compression and isobaric heat dissipation, the adiabatic compression being carried out by the compressor and the isobaric heat dissipation being carried out in the condenser together with remaining process part occurring in the superheated vapor zone of the isothermal heat dissipation under isothermal and isobaric condition. A part of the isobaric heat dissipation in the liquid zone is carried out in the regeneration heat exchanger by releasing heat from refrigerant liquid to refrigerant vapor entering the compressor, remaining process part of the isobaric heat dissipation in the liquid zone is substituted by isenthalpic or isentropic expansion, the expansion being carried out by the expansion means, and expanded refrigerant is introduced to the evaporator to carry out isothermal and isobaric heat absorption and then to be sucked into the compressor.

12 Claims, 12 Drawing Sheets

FOREIGN PATENT DOCUMENTS

| | | | | |
|---|---|---|---|---|
| JP | 55-60158 | A | | 5/1980 |
| JP | 8200847 | A | | 8/1996 |
| JP | 10-47794 | A | | 2/1998 |
| JP | 2000179960 | A | | 6/2000 |
| JP | 2001272116 | A | | 10/2001 |
| JP | 2002-156161 | A | | 5/2002 |
| JP | 2003121012 | A | * | 4/2003 |
| JP | 2003176957 | A | | 6/2003 |
| JP | 2004-108617 | A | | 4/2004 |
| JP | 2004270966 | A | | 9/2004 |
| WO | 95/23943 | A | | 9/1995 |
| WO | 2004088219 | A1 | | 10/2004 |

OTHER PUBLICATIONS

Office Action issued on Jan. 14, 2011 for corresponding JP Patent Application No. 2008-540371 English Translation provided.

Office Action issued on Sep. 22, 2009 for corresponding EP Patent Application No. 06822422.9.

* cited by examiner

VAPOR COMPRESSION REFRIGERATING CYCLE, CONTROL METHOD THEREOF, AND REFRIGERATING APPARATUS TO WHICH THE CYCLE AND THE CONTROL METHOD ARE APPLIED

This application is a U.S. National Phase Application of PCT International Application PCT/JP2006/321453 filed on Oct. 20, 2006 which is based on and claims priority from JP 2006-086601 filed on Mar. 27, 2006, the contents of which is incorporated herein in its entirety by reference.

TECHNICAL FIELD

The present invention relates to a vapor compression refrigerating cycle applied to a refrigerator and air conditioner, control methods thereof, and a refrigerating apparatus to which the cycle and control methods are applied.

BACKGROUND ART

A system of typical vapor compression refrigerating cycle is composed as shown schematically in FIG. 13. The cycle is shown in FIG. 14 as a T-S diagram with temperature as the ordinate and entropy as the abscissa, in which the cycle operates the process a-b'-c-d"-a.

That is, saturated vapor of a refrigerant at point a is compressed adiabatically to point b' by a compressor 02, then cooled from point b to point a under constant pressure in a condenser 04 to be condensed to saturated liquid at point c while heat quantity of Q1 being deprived of the refrigerant. The saturated liquid is expanded through an expansion means (expansion valve) 06 to be decreased in pressure from P2 to P1 through an isenthalpic expansion process c-d". The refrigerant is in a state of wet vapor at point d", i.e. a mixture of saturated liquid of state point c and saturated vapor of state point a. The saturated liquid in the wet vapor evaporates in an evaporator 08 under pressure P1 and absorbs heat quantity of Q2 from specified substance, thus refrigeration is effected.

A vapor compression refrigerating cycle like this can be considered as a cycle based on the reversed Carnot cycle.

FIG. 16 shows the Carnot cycle on a T-S diagram. When the Carnot cycle is operated in a reversed direction, i.e. in a direction shown by arrows to operate the process of a-b-c-d, a refrigerating cycle is effected. In FIG. 16, the process a-b is adiabatic compression, process b-c is isothermal compression, process c-d is adiabatic expansion, and process d-a is isothermal expansion.

Applying the reversed Carnot cycle of FIG. 16 to the T-S diagram of the vapor compression refrigerating cycle of FIG. 14, each of processes a-b, b-c, c-d, and d-a in FIG. 14 can be considered to correspond to each of processes represented by the same symbols in the reversed Carnot cycle of FIG. 16. That means that the vapor compression refrigerating cycle can be considered as a cycle for operating the below the line of saturation (saturated liquid line l-l' and dry saturated vapor line m-m', both lines coincide at the critical point not shown in the drawing). In FIG. 14, a-b is adiabatic compression process, b-g is isothermal compression process, g-c is isothermal condensation process, c-d is adiabatic expansion process, and d-a is isothermal evaporation process.

The feature of the reversed Carnot cycle a-b-c-d-a in FIG. 14 can be considered schematically that the isothermal compression process b-c and isothermal expansion process d-a of the Carnot cycle are replaced by the condensation process g-c and evaporation process d-a by allowing a large part of the cycle to operate below the line of saturation with only the process b-g belonging to a part of isothermal compression process of the Carnot cycle.

As isothermal compression process is difficult to realize, the process b-g outside the dry saturated vapor line is replaced by the adiabatic compression process b-b' and isobaric cooling process b'-g in the actual vapor compression refrigerating cycle.

Also, as isentropic expansion process c-d is difficult to realize in adiabatic expansion of 2-phase refrigerant consisting of vapor and liquid refrigerant in the actual vapor compression refrigerating cycle, isenthalpic expansion process c-d" is substituted for the isentropic expansion process c-d by use of an expansion valve in the actual vapor compression refrigerating cycle.

FIG. 15 is a P-H diagram (pressure-enthalpy diagram) for T-S diagram of FIG. 14.

As has been explained, the typical vapor compression refrigerating cycle can be considered a practical cycle based on the reversed Carnot cycle.

More specifically, as mentioned above, the feature of the vapor compression refrigerating cycle can be considered a cycle intended for putting the Carnot cycle to practical use, in which a large part of the isothermal compression process of the reversed Carnot cycle a-b-c-d-a of FIG. 16 is replaced by the isothermal condensation process g-c by utilizing the characteristic of wet vapor below the line of saturation, the remainder, i.e. the process b-g, is replaced by the adiabatic compression process b-b' and isobaric process b'-g, further the isentropic expansion process is replaced by the isenthalpic expansion process which is realized by use of an expansion valve, and the isothermal expansion process by the isothermal evaporation process.

By the way, there is known the Stirling cycle and Ericsson cycle as reversible cycles in addition to the Carnot cycle.

FIG. 17 is a T-S diagram of the reversed Stirling cycle, in which process a-b is isometric heat absorption, process b-c is isothermal compression, process c-d is isometric heat dissipation, and process d-a is isothermal expansion. The amount of heat absorbed in the isometric heat absorption process a-b is equal to that dissipated in the isometric heat dissipation process c-d, the heat exchange being done through the intermediary of a regenerating heat exchanger.

FIG. 18 is a T-S diagram of the reversed Ericsson cycle, in which process a-b is isobaric heat absorption, process b-c is isothermal compression, process c-d is isobaric heat dissipation, and process d-a is isothermal expansion. The amount of heat absorbed in the isobaric heat absorption process a-b is equal to that dissipated in the isobaric heat dissipation process c-d, the heat exchange being done through the intermediary of a regenerating heat exchanger.

There are many proposals of refrigerators using the typical vapor compression refrigerating cycle such as disclosed for example in Japanese Laid-Open Patent Application No. 2004-108617, No. 2002-156161. In Japanese Laid-Open Patent Application No. 55-60158 is recited the theoretical coefficient of performance when considering the vapor compression refrigerating cycle as the reversed Carnot cycle (see page 2, the middle part of upper right column of the official gazette), thus it is known to evaluate the vapor compression refrigerating cycle presuming the reversed Carnot cycle of the vapor compression refrigerating cycle.

DISCLOSURE OF THE INVENTION

As to the improvement of efficiency of the conventional vapor compression refrigerating cycle, there have been many proposals as has been disclosed in patent literatures mentioned above.

However, further improvement of efficiency is desired.

The object of the present invention is to provide a vapor compression refrigerating cycle, control methods thereof, and a refrigerating apparatus adopting the method, with which operation efficiency exceeding the conventional vapor compression refrigerating cycle can be attained, by modifying the basic cycle of vapor compression refrigerating cycle, that is, by modifying the basic cycle of vapor compression refrigerating cycle from the reversed Carnot cycle to the reversed Ericsson cycle.

To attain the object, the present invention proposes a vapor compression refrigerating cycle comprising a compressor, a condenser, a regeneration heat exchanger, an expansion means, and an evaporator connected in series, wherein said cycle is based on a cycle corresponding to a reversed Ericsson cycle in which isothermal heat dissipation process and isothermal heat absorption process occur overstriding a saturated vapor line and saturated liquid line respectively and heat exchange is carried out between isobaric heat dissipation process in a liquid zone and isobaric heat absorption process in a superheated vapor zone, and wherein a process part occurring in a superheated vapor zone of said isothermal heat dissipation process in said reversed Ericsson cycle (an isothermal compression process) is substituted by adiabatic compression process and isobaric heat dissipation process, said adiabatic compression being carried out by said compressor and said isobaric heat dissipation being carried out in said condenser together with remaining process part occurring in said superheated vapor zone of said isothermal heat dissipation process under isothermal and isobaric condition, a part of said isobaric heat dissipation process in the liquid zone is carried out in said regeneration heat exchanger by releasing heat from refrigerant liquid in the liquid zone to refrigerant vapor entering said compressor, remaining process part of said isobaric heat dissipation process in the liquid zone is substituted by isenthalpic or isentropic expansion, the expansion being carried out by said expansion means, and expanded refrigerant is introduced to said evaporator to carry out isothermal and isobaric heat absorption and then to be sucked into said compressor.

Said reversed Ericsson cycle as shown in a T-S diagram of FIG. 1 by process of a-b-g-c-d-a is called here a theoretical vapor compression Ericsson cycle.

According to the invention, a vapor compression refrigerating cycle of a-b-b'-g-c-d'-e'-a or a-b-b'-g-c-d'-e"-a shown in a T-S diagram of FIG. 1 by modifying said reversed Ericsson cycle, i.e. theoretical vapor compression Ericsson cycle, performed overstriding a saturated vapor line and saturated liquid line such that reversible isothermal compression process b-g is substituted by adiabatic compression process b-b' and isobaric heat dissipation process b'-g, and a part of reversible isobaric heat dissipation process c-d is substituted by isenthalpic or isentropic expansion respectively.

FIG. 2 is a P-H diagram corresponding to the T-S diagram of FIG. 1. Cycle a-b-g-c-d-a shown in FIG. 1 and FIG. 2 is defined here as a theoretical vapor compression Ericsson cycle. This reversed Ericsson cycle a-b-g-c-d-a operates overstriding the dry saturated vapor line mm' and saturated liquid line ll'. Process a-b is reversible isobaric heat absorption, process b-g-c is isothermal compression, process c-d is reversible isobaric heat dissipation, and process d-a is isothermal expansion. The reversible isobaric process c-d is operated in the liquid zone outside the saturated liquid line, the reversible isobaric heat absorption a-b is operated in the vapor zone outside the dry saturated vapor line, a large part of the isothermal compression b-g-c (high-pressure side isothermal process) consists of condensation process, and a large part of the isothermal process d-a consists of evaporation process.

The isothermal process b-c of said reversed Ericsson cycle (theoretical vapor compression Ericsson cycle) consists of a partial process b-g and a partial process g-c, the partial process b-g being isothermal compression process and the partial process g-c is isothermal condensation process.

In FIG. 1, in order that the reversed Ericsson cycle is effected by the cycle a-b-g-c-d-a, the heat amount absorbed in the reversible heat absorption process a-b and the heat amount dissipated in the isobaric heat dissipation process c-d must be equal. However, these heat amounts are not equal in general with a usual refrigerant, because the heat absorption is effected in a vapor phase and heat dissipation is effected in a liquid phase and physical properties (such as specific heat) differ resulting in unequal specific enthalpy difference between both the processes. Therefore, temperature difference arises between liquid side average temperature and vapor side average temperature in the regeneration heat exchanger in which heat exchange is performed between reversible isobaric heat absorption process a-b and reversible isobaric heat dissipation process c-d, and reversible heat exchange is impossible.

When d' is a point on the line c-d, at which state point the specific enthalpy difference between the point d' and c is equal to that between the point a and b, and if isenthalpic expansion d'-e" is performed, a cycle a-b-g-c d'-e"-a is an irreversible cycle.

FIG. 3 is a graph showing liquid side temperature changes and vapor side temperature changes in the regeneration heat exchanger. As shown in the graph, even in the case high temperature side liquid refrigerant temperature and low temperature side vapor refrigerant temperature coincide with each other at the high temperature side end and low temperature side end respectively of the regeneration heat exchanger, temperature difference ⊿TB arises between the high temperature side liquid refrigerant and low temperature side vapor refrigerant inside the heat exchanger, so irreversible heat exchange can not be evaded in the regeneration heat exchanger.

However, it is theoretically possible to allow the temperature difference between the liquid refrigerant and vapor refrigerant at the high-temperature side end and low temperature side end respectively of the regeneration heat exchanger to be zero as shown in FIG. 3, and when this is realized the cycle is defined here as a vapor compression Ericsson cycle.

Temperature difference between liquid refrigerant vapor refrigerant at the low temperature side end and high temperature side end respectively of the regeneration heat exchanger can be reduced to zero by widening the isobaric heat absorption process a-b to f-a-b so that vapor side specific enthalpy difference is equal to liquid side specific enthalpy difference.

This is possible by controlling so that the state of refrigerant at the vapor side inlet is shifted from the sate point a to a state point f in the wet vapor zone.

The reason why refrigerating capacity of the vapor compression refrigerating cycle of the invention is increased compared with the typical conventional vapor compression refrigerating cycle with the same refrigerant flow will be explained hereunder.

The refrigerating capacity of the typical vapor compression refrigerating based on the reversed Carnot cycle is ΔHac as shown in FIG. 14, and that of the vapor compression refrigerating cycle of the invention is ΔHad' as shown in FIG. 1 and FIG. 2. As ΔHad'=ΔHac+ΔHba, in the reversed Ericsson cycle of the invention, refrigerating capacity always increases by ΔHba compared with that of the conventional cycle even when the state of refrigerant a the vapor side inlet of the refrigerating heat exchange varies between a section a-f. That is, refrigerant capacity increases by the heat amount corresponding the heat amount which the vapor sucked into the compressor is heated in the regeneration heat exchanger when mass flow of refrigerant is the same.

Said increase of refrigerating capacity will be explained using enthalpies at each of the state points and relations between the enthalpies.

In FIG. 1, heat exchange is carried out between refrigerant in vapor phase in isobaric heat absorption process a-b and that in liquid phase in isobaric heat dissipation process c-d in the regeneration heat exchanger. Since difference of enthalpy of the process a-b is not equal to that of the process c-d, a state point d' is determined in the process c-d so that the following equation (1) is sufficed.

$$Hb-Ha=Hc-Hd' \quad (1)$$

Similarly, state point f is determined on the evaporation line Y in FIG. 2 by the following equation (2) so that a heat amount same to the heat amount dissipated in the process c-d is exchanged in process f-b.

$$Hb-Hf=Hc-Hd \quad (2)$$

The equation (2) means that the state of refrigerant at the vapor side inlet of the regeneration heat exchanger is shifted from point a at which refrigerant vapor is in a state of saturated vapor to point f at which refrigerant vapor is in a state of wet vapor in order to allow the reversed Ericsson cycle a-b-g-c-d-a to be performed.

When refrigerant at the vapor side inlet of the regeneration heat exchanger is saturated vapor as shown by point a in FIGS. 1 and 2, refrigerant capacity is given by the following equation (3).

$$\phi a=Ha-Hd' \quad (3)$$

On the other hand, when refrigerant at the vapor side inlet of the regeneration heat exchanger is wet vapor as shown by point f in FIGS. 1 and 2, refrigerant capacity is given by the following equation (4).

$$\phi f=Hf-Hd \quad (4)$$

Refrigerating capacity of the conventional vapor compression refrigerating cycle based on the reversed Carnot cycle is given by the following equation (5).

$$\phi c=Ha-Hc \quad (5)$$

Difference $\Delta\phi$ in refrigerating capacity of the cycle of the invention and that of the conventional cycle can be obtained from equations (2)-(5) and given by the following equations (6) and (7).

When refrigerant at the vapor side inlet of the regeneration heat exchanger is saturated vapor as shown by point a, $$\Delta\phi a=\phi a-\phi c=(Ha-Hd')-(Ha-Hc)=Hc-Hd'=Hb-Ha \quad (6)$$

and when refrigerant at the vapor side inlet of the regeneration heat exchanger is saturated vapor as shown by point f, $$\Delta\phi f=\phi f-\phi c=(Hf-Hd)-(Ha-Hd)=(Hc-Hd)-(Ha-Hf)=Hb-Ha \quad (7)$$

It is recognized from equations (6) and (7) that refrigerating capacity is increased by heat amount Hb−Ha which corresponds to a heat amount to superheat refrigerant in both cases mentioned above compared with the conventional cycle.

Although flow rate sucked by a compressor varies depending on change in the state of refrigerant vapor at the entrance to the compressor in the conventional cycle, the state of refrigerant vapor at the entrance to the compressor is always constant even if the state of refrigerant at the vapor side entrance to the regeneration heat exchanger varies between the section a-f in the cycle of the invention. Therefore, the cycle of the invention has a characteristic that compression power is the same in the same operation condition, that is, refrigerant flow rate and compression power are invariant. Accordingly, it is understandable that, in a refrigerating apparatus applying the cycle of the invention, refrigerating capacity and compression power is invariant, that is, COP (coefficient of performance) is invariant even when the state of refrigerant at the vapor side entrance to the regeneration heat exchanger varies between the section a-f. Thus, refrigerating capacity of the cycle of the invention increases compared to that of the typical conventional vapor compression refrigerating cycle based on the reversed Carnot cycle with the same mass flow rate of refrigerant.

It is preferable that the regeneration heat exchanger is located so that its vapor side is between said evaporator and compressor and its liquid side is between said condenser and expansion means, and a control means is provided for controlling refrigerating capacity by controlling dryness of refrigerant vapor entering the vapor side of the regeneration heat exchanger.

As regards COP of the typical conventional vapor compression refrigerating cycle and that of the cycle of the invention, general comparison can not done as to which is larger or smaller. This is because suction temperature of the compressor is different and so refrigerant flow rate is different for the same condensation and evaporation condition. Large or small of COP depends on physical properties of refrigerant, and it is necessary to estimate based on the physical properties.

Results of simulation are shown in FIG. 6 and FIG. 7. In these drawings, the abscissa represents temperature of refrigerant vapor at the exit of the regeneration heat exchanger (vapor side outlet temperature), the ordinate represents COP in FIG. 6 and factors of multiplication of volumetric capacity in FIG. 7. The simulation was carried out with evaporation temperature (Te) of −40° C. and condensation temperature (Tc) of 40° C., parameter being kinds of refrigerants.

Volumetric capacity (kJ/m$^3$) is refrigerating capacity (kw) per unit flow rate (m$^3$/s) of refrigerant through compressor, and the factor of multiplication of volumetric capacity means the ratio of the volumetric capacity of the cycle of the invention to that when ammonia refrigerant is adiabatically compressed from an evaporation temperature of −40° C. of saturated vapor state to a pressurized state at which condensation temperature is 40° C. (degree of supercool=0).

As to the meaning the abscissa of each of the drawings, when temperature on the abscissa is −40° C., the refrigerant is in a state of deficient dryness (excessive wetness fraction) at the vapor side entrance of the heat exchanger and the temperature at the exit is −40° C. (suction temperature of the compressor is −40° C.).

Similarly, when temperature on the abscissa is 40° C., the refrigerant is in a state of optimal dryness (optimal wetness fraction) at the vapor side entrance of the heat exchanger and vapor side outlet temperature is 40° C. (liquid side outlet temperature is −40° C.). When vapor side outlet temperature is between both the temperatures, the refrigerant is in a state of deficient dryness (excessive wetness fraction) at the vapor side entrance of the heat exchanger.

Form FIG. 6 it is recognized that COP of the cycle of the invention is at its maximum when vapor side outlet temperature in the regeneration heat exchanger, i.e. vapor temperature sucked into the compressor is equal to condensation temperature in the condenser for all refrigerants shown in FIG. 6 except ammonia. As explained in regard to FIG. 4, COP is at its maximum when the state of refrigerant at the vapor side entrance of the regeneration heat exchanger is in the section a-f, i.e. when dryness X is Xf≦X≦Xa=1 (Xf, Xa are dryness at point a, f respectively). On the other hand, COP of the cycle of the invention is the same as that of the conventional cycle when the state of refrigerant at the vapor side entrance of the regeneration heat exchanger is at a state point h. From this, it is understandable that COP of the cycle of the invention is larger than that of the conventional cycle when the state of refrigerant at the vapor side entrance of the regeneration heat exchanger varies between the section a-h for almost all refrigerants except ammonia.

Further, in FIG. 7 is shown how refrigerating capacity of the cycle of the invention changes for the same compressor. As mentioned before, in FIG. 7 are shown factors of multiplication of volumetric capacity for a variety of refrigerants using volumetric capacity for ammonia when vapor side outlet temperature in the regeneration heat exchanger is −40° C. as the basis (putting factor of multiplication of volumetric capacity=1 in this case). As the volumetric capacity is refrigerating capacity per unit refrigerant flow, it can be considered as representing refrigerating capacity when the same compressor is applied.

Volumetric capacity tends to increase as vapor side outlet temperature in the regeneration heat exchanger increases for all of the refrigerants in FIG. 7 except ammonia and R32 refrigerant, so volumetric capacity is at its maximum with the cycle of the invention for all of the refrigerants except ammonia and R32, and COP is at its maximum for all of the refrigerants except ammonia as can be recognized from FIG. 6.

As has been understood from above description, refrigerating capacity and COP can be maximized by controlling dryness of refrigerant entering the vapor side entrance of the regeneration heat exchanger.

Maximization of refrigerating capacity and COP will be detailed hereunder using enthalpies at each of the state points and relations between them.

Refrigerant capacity when refrigerant state at the vapor side inlet of the regeneration heat exchanger is shifted inside and outside of the section F-a in FIGS. 1 and 2 will be explained using dryness of the refrigerant in three cases.

(Case 1)

Refrigerating capacity $\phi_1$ when Xf≦X≦1, is given by the following equation (9), for the following equation (8) is obtained from equations (1)-(4).

$$Ha-Hd'=Hf-Hd \tag{8}$$

$$\phi 1=\phi a=\phi f \tag{9}$$

Therefore, when dryness X is Xf≦X≦1, refrigerating capacity does not depend on dryness X of refrigerant at vapor side inlet of the refrigerating heat exchanger.

(Case 2)

When Xf<X, and refrigerant at vapor side inlet of the regeneration heat exchanger is as shown by point h in FIGS. 1 and 2, refrigerating capacity $\phi 2$ is given by the following equation (10) and the following inequation (11) is obtained.

$$\phi 2=Hh-Hd \tag{10}$$

$$\phi 1>\phi 2 \tag{11}$$

Thus, refrigerating capacity decreases with increase of dryness X.

(Case 3)

When X=1, and Tb≧Ta'>Ta, and refrigerant at vapor side inlet of the regeneration heat exchanger is superheated as shown by point a' in FIGS. 1 and 2, refrigerating capacity $\phi 3$ is given by the following equation (12) and the following inequation (13) is obtained.

$$\phi 3=\phi c+\phi 3aa'+(Hb-Ha') \tag{12}$$

$$\phi 1\geqq\phi 3 \tag{13}$$

As to right side of equation (12), the first term is refrigerant capacity in the case of the conventional cycle, the second term is refrigerating capacity corresponding to a cooling effect (Ha'-Ha) due to super heating the refrigerant vapor entering into the compressor, and the third term is refrigerating capacity increased due to Ericsson Cycle. Only when the second term is utilized as effective refrigerating capacity, equation (12) is effective. Therefore, when the amount of heat to superheat the refrigerant vapor entering the compressor is effectively utilized, $\phi 1$ becomes equal to $\phi 3$ and refrigerating capacity is at maximum in a range of superheated state of point a'.

From above explanation, it will be understood that refrigerating capacity becomes maximum when dryness X of refrigerant at the vapor side inlet of the regeneration heat exchanger is Xf≦X≦1 (in case 1 and case 3).

It is preferable that an injection means is provided which injects a part of liquid refrigerant introduced from a part between a liquid outlet of said regeneration heat exchanger and an inlet of said expansion means into said compressor in order to control refrigerant temperature at an outlet of said compressor to be a prescribed temperature.

With this construction, refrigerant temperature at the outlet of the compressor can be lowered by injecting a part of the low-temperature liquid refrigerant irrespective of displacement type or centrifugal type compressor. Therefore, the possibility is eliminated that, in an oil-free compressor or a compressor in which the concentration of lubricant in the compression process in the compressor is low, if the injection of liquid refrigerant is not done, discharge temperature from the compressor becomes fairly high when inlet temperature rises to near condensation temperature, decomposition of the refrigerant and lubricant occurs, and operation becomes impossible as a matter of practice.

In the simulation based on physical properties of refrigerants of which the results are shown in FIG. 6 and FIG. 7, estimation was carried out by assuming the temperature of refrigerant vapor at the outlet of the compressor to be about 80° C. using examples from oil injection type screw compressor. Therefore, decrease in refrigeration capacity corresponding to the amount the liquid injection will be resulted when the liquid injection is done. However, there is a possibility that improvement of COP can be attained compared with the conventional vapor compression refrigerating cycle without the liquid injection even if the temperature of refrigerant vapor at the outlet of the compressor is controlled to be about 80° C. (prescribed value) with the liquid injection. If increase of COP larger than decrease of COP due to the liquid injection is possible in the cycle of the invention, COP can be increased in the cycle of the invention than that of the conventional cycle.

It is preferable that the adiabatic compression and isobaric heat dissipation process substituted for a process part occurring in a superheated vapor zone of said high temperature side isothermal heat dissipation process of the reversed Ericsson cycle (an isothermal compression process) is composed of multistage adiabatic compression and multistage isobaric heat dissipation process.

In this way, when the number of stages is increased infinitely, effect of adiabatic compression is eliminated and the compression process converges into an isothermal compression process, and the inlet temperature in the compression process and compression temperature becomes equal to condensing temperature. This means that environmental temperature (temperature of the ambient air) can be used as a low temperature source needed for isothermal compression, which is very advantageous from practical point of view. The Ericsson cycle has isothermal processes and has not adiabatic processes. By applying multistage adiabatic compression processes and multistage heat dissipating processes, the processes can be approximated to an isothermal compression process under the environmental temperature, and power for compressing refrigerant can be reduced.

The methods of the present invention are used for the vapor compression refrigerating cycle of the present application. One aspect of the invention is characterized in that refrigerating capacity is controlled by controlling dryness of refrigerant vapor entering the vapor side of the regeneration heat exchanger.

Another aspect of the invention is characterized in that dryness X of refrigerant vapor at a vapor side inlet of said heat exchanger is controlled to be in a range between Xh with which the state of the refrigerant vapor at the vapor side outlet of the heat exchanger is in its dry saturated vapor state and dryness of 1 with which the temperature of the refrigerant vapor at the vapor side outlet of the heat exchanger is at the condensation temperature in the condenser, that is, $Xh \leqq X \leqq 1$.

Another aspect of the invention is characterized in that dryness X of refrigerant vapor at a vapor side inlet of said regeneration heat exchanger is controlled so that temperature of refrigerant at the vapor side outlet of said regeneration heat exchanger is maintained near condensing temperature in said condenser and liquid side outlet temperature of said regeneration heat exchanger is maintained near evaporation temperature in said evaporator.

Another aspect of the invention is characterized in that inlet and outlet temperature of the vapor side and liquid side of said regeneration heat exchanger are detected, flow rate of high-pressure liquid refrigerant passing through said expansion means is controlled so that when liquid side outlet temperature is higher than vapor side inlet temperature in said regeneration heat exchanger said flow rate is increased, and when liquid side inlet temperature is higher than vapor side outlet temperature in said regeneration heat exchanger said flow rate is decreased, thereby maintaining each of temperature differences in lower temperature side and higher temperature side of the heat exchanger within a prescribed value.

According to the invention, refrigerating capacity and COP can be maximized by controlling dryness of the refrigerant entering the vapor side entrance of the regeneration heat exchanger as explained before.

Further, COP of the cycle of the invention can be increased than that of the typical conventional vapor compression refrigerating cycle by controlling dryness X of refrigerant vapor at a vapor side inlet of said heat exchanger is controlled to be in a range between Xh with which the state of the refrigerant vapor at the vapor side outlet of the heat exchanger is in its dry saturated vapor state and dryness of 1 with which the temperature of the refrigerant vapor at the vapor side outlet of the heat exchanger is at the condensation temperature in the condenser, that is, $Xh \leqq X \leqq 1$.

In FIG. 4 is shown a relation between dryness and COP and refrigerating capacity in the cycle of the invention, in which COP is constant in the section a-f of dryness of the state of refrigerant at the vapor side inlet of the regeneration heat exchanger. This shows that the state of refrigerant at the inlet of the compressor, i.e. at the vapor side outlet of the regeneration heat exchanger, remains constant at the state point b in FIG. 1 regardless of change of the state of refrigerant at the vapor side inlet of the regeneration heat exchanger between the state point a and f.

That the minimum of COP of the cycle of the invention is equal to COP of the typical conventional vapor compression refrigerating cycle base on the Carnot cycle when refrigerant vapor at the vapor side inlet is at point h in FIG. 4 will be explained hereunder. In FIG. 4 is depicted with broken lines the cycle of the invention a-b-b'-g-c-d-e-a as a P-H diagram and explanation will be done referring to the lines. When dryness is decreased (wetness fraction is increased) in the section f-h, vapor side outlet temperature of the regeneration heat exchanger decreases from the point b toward the point a. On the other hand, the state of refrigerant at the liquid side outlet of the regeneration heat exchanger remains unchanged at the state point d. When dryness factor of refrigerant at the vapor side inlet of the regeneration heat exchanger reaches the state point h, the state of refrigerant at the inlet of the compressor comes to the state point a, and the effect of increase of refrigerating capacity ($\Delta Hba$) owing to the heat exchanger becomes zero. That is, operation condition of the cycle of the invention is the same as that of the typical conventional vapor compression refrigerating cycle. Therefore, when the state of refrigerant at the vapor side inlet of the heat exchanger is at the state point h, refrigerating capacity and COP are the same for the cycle of the invention and the conventional cycle with the same compressor.

When the state of refrigerant at the vapor side inlet of the regeneration heat exchanger is in the section f-a, COP of the cycle of the invention is constant and at its maximum, so refrigerating capacity and COP tend to rise rightward as shown in FIG. 6 and FIG. 7. As to refrigerating capacity, this tendency is apparent in FIG. 7 for a variety of refrigerant except ammonia and R32.

Therefore, refrigerating capacity is at its maximum when dryness X of refrigerant vapor at the vapor side inlet of the regeneration heat exchanger is $Xf \leqq X \leqq 1$ and refrigerant temperature at the inlet of the compressor, that is, at vapor side outlet of the regeneration heat exchanger is Tb. Refrigerating capacity is the maximum when refrigerant temperature at the vapor side outlet of the refrigerating heat exchanger is between saturated vapor temperature Ta at the state point a and condensing temperature Tb in the condenser Therefore, both the refrigerating capacity and COP of the cycle of the invention can be increased than those of the typical conventional vapor compression refrigerating cycle by controlling dryness X of the refrigerant vapor at the vapor side inlet of the regeneration heat exchanger to be in the range between Xh with which the state of the refrigerant vapor at the vapor side outlet of the regeneration heat exchanger is in its dry saturated vapor state and X=1 with which the vapor side outlet temperature of the regeneration heat exchanger is the condensation temperature in the condenser, i.e. $Xh \leqq X \leqq 1$.

According to the invention, refrigerating capacity and COP are maximized as shown in FIGS. 6 and 7 showing simulation result by controlling dryness of refrigerant at the vapor side inlet of the heat exchanger to be an optimum dryness so that in the regeneration heat exchanger refrigerant vapor is maintained at the vapor side outlet at a temperature near condensation temperature Tb in the condenser and liquid refrigerant at the liquid side outlet is maintained at a temperature near evaporation temperature Td in the evaporator.

Although refrigerating capacity and COP is constant in the section a-f, it is thought best when refrigerant vapor at the inlet of the regeneration inlet is in the state of point f.

The reasons that the point f is the optimum point in spite of the fact that refrigerating capacity does not vary in the section a-f, is that dryness is the smallest (wetness fraction is the largest) at the point f in the section a-f, so degree of cooling of the refrigerant liquid is largest and generation of flash gas at the expansion through the expansion valve is the smallest (zero or extremely small), that is, volume change by expansion is the smallest, and that occurrence of corrosion/erosion of the expansion valve by the flash gas is prevented, that dryness after expansion decrease (wetness fraction increases), so heat transfer coefficient in the evaporator increases and heat loss in the evaporator decreases.

Further, refrigerating capacity and COP can be maximized by controlling refrigerant temperature at the vapor side outlet of the regeneration heat exchanger to be condensation temperature Tb in the condenser and controlling refrigerant temperature at the liquid side outlet temperature of the regeneration heat exchanger to be evaporating temperature Td in the evaporator, so the invention is effective to save power requirements at normal operation as a matter of course, effective for energy-saving by the reduction of cool-down time period (cooling-down at operation start of refrigerator and cooling-down at rapid load increase), for the prevention of liquid backflow at rapid load change, and also for quality improvement of cooled articles.

Another aspect of the invention will be explained with reference to FIG. 3. FIG. 3 is a graph showing liquid side temperature changes and vapor side temperature changes in the regeneration heat exchanger.

There may occur three states of refrigerant vapor at the entrance to the heat exchanger 6, i.e. state of too small dryness (excessive wetness fraction), optimal dryness (optimal wetness fraction), and excessive dryness (too small wetness fraction).

In the graph of FIG. 3 are shown vapor side and liquid side temperature change when the dryness is too small (excessive wetness fraction) by a curve A (broken line) and curve A' (broken line) respectively, vapor side and liquid side temperature change when the dryness is optimal (optimal wetness fraction) by a curve B (solid line) and curve B' (solid line) respectively, and vapor side and liquid side temperature change when the dryness is excessively large (too small wetness fraction) by a curve C (chain line) and curve C' (chain line) respectively.

It is possible to control so that the temperature change curve between a low temperature side end and high temperature side end of the regeneration heat exchanger to be between curves B and B' that correspond to the case the dryness of the refrigerant vapor of the inlet side of the heat exchanger is optimal by detecting the temperatures of refrigerant at four points, i.e. vapor temperature and liquid temperature at their low temperature side (vapor side inlet and liquid side outlet respectively) and at their high temperature side (vapor side outlet and liquid side inlet respectively) in the regeneration heat exchanger and controlling flow rate of refrigerant flowing through the expansion means. That is, the temperature change in the regeneration heat exchanger can be maintained to occur along the vicinity of curve B and B' by controlling so that the flow rate of the high-pressure liquid refrigerant flowing into the expansion means is reduced when dryness is too small (wetness fraction is excessive) as shown by the curve A, A', that is, when temperature difference A TA at high-temperature side ends exceeds a prescribed value (liquid inlet temperature T4–vapor outlet temperature T2>prescribed value (for example 5° C.)), and the flow rate of the high-pressure liquid refrigerant flowing into the expansion means is increased when dryness is excessive (wetness fraction is insufficient) as shown by the curve C, that is, when temperature difference ⊿TC at low temperature side ends exceeds a prescribed value (liquid outlet temperature T3–vapor inlet temperature T1>prescribed value (for example 5° C.)). Thus, by controlling the flow rate of refrigerant to the expansion means so that both the temperature differences in the regeneration heat exchanger are kept within a prescribed value (for example 5° C.), dryness of refrigerant vapor in the vapor side inlet of the regeneration heat exchanger can be maintained to be at optimal.

In the present invention, there are proposed refrigerating apparatuses applying the vapor compression cycle of the invention.

One refrigerating apparatus of the present invention is composed such that a part of refrigerant vapor flowing in a vapor side heat transfer path in said regeneration heat exchanger is diverted from the path at a midway along the path via a flow rate regulation valve and the diverted refrigerant vapor is introduced into a cooling-load device, and refrigerant flowing out from the cooling-load device and refrigerant flowing out from the outlet of said regeneration heat exchanger are introduced into said compressor. With this composition, the cooling-load device can be cooled by utilizing the increment (ΔHba) of refrigerating capacity gained by the refrigerating cycle applying the inversed Ericsson cycle of the invention. Further, the apparatus is better fitted for maintaining the cooling-load device to a temperature near that of condensing temperature Tb, for refrigerant diverted from the heat transfer path in the regeneration heat exchanger is introduced to the cooling-load device via the flow regulation valve.

Another refrigerating apparatus of the present invention is composed such that a part of refrigerant vapor flowing out from said evaporator is diverted via a flow regulation valve to be introduced into a cooling-load device and refrigerant flowing out from the cooling-load device is introduced to a midway along the vapor side heat transfer path in the regeneration heat exchanger or to the outlet of the regeneration heat exchanger.

With this composition, the cooling-load device can be cooled by utilizing the increment (ΔHba) of refrigerating capacity gained by the refrigerating cycle applying the inversed Ericsson cycle of the invention. Further, the apparatus is better suited for maintaining the cooling-load device to still lower temperature, for a part of the refrigerant flowing out from the evaporator 10 is diverted to be introduced to the cooling-load device 24 directly and the cooling-load device can be cooled effectively.

Another refrigerating apparatus of the present invention is composed such that a part of refrigerant vapor flowing in a vapor side heat transfer path in said regeneration heat exchanger is diverted from the path at a midway along the path via a flow rate regulation valve and the diverted refrigerant vapor is introduced into a cooling-load device, and refrigerant flowing out from the cooling-load device is returned to said vapor side heat transfer path at a position downstream from said midway position from where refrigerant is diverted.

With this composition, the cooling-load device can be cooled by utilizing the increment (ΔHba) of refrigerating capacity gained by the refrigerating cycle applying the inversed Ericsson cycle of the invention. Further, refrigerant diverted at the branch point is flown through the cooling-load device and then all the refrigerant flown through the cooling-load device is returned again to the regeneration heat exchanger from which then introduced to the inlet of the compressor, so refrigerant vapor is returned to the compressor after sufficiently adjusted in temperature in the regeneration heat exchanger. Therefore, compared with the apparatus of other aspect of the present invention in which the diverted refrigerant interflows into the refrigerant flow from the regeneration heat exchanger at the inlet of the compressor, temperature of refrigerant can be adjusted in a wider range and a wide range of temperatures of cooling loads from evaporation temperature in the evaporator to condensing temperature in the condenser can be accommodated to by the apparatus.

A refrigerating apparatus of another aspect is composed such that a control means is provided for controlling said flow regulation valve so that dryness X of refrigerant vapor at a vapor side inlet of said heat exchanger is controlled to be in a range between Xh with which the state of the refrigerant vapor at the vapor side outlet of the heat exchanger is in its dry saturated vapor state and dryness of 1 with which the temperature of the refrigerant vapor at the vapor side outlet of the heat exchanger is at the condensation temperature in the condenser, that is, $Xh \leqq X \leqq 1$.

Further, by allowing said control means to controls so that dryness X of refrigerant vapor at a vapor side inlet of said regeneration heat exchanger so that temperature of refrigerant at the vapor side outlet of said regeneration heat exchanger is maintained near condensing temperature in said condenser and liquid side outlet temperature of said regeneration heat exchanger is maintained near evaporation temperature in said evaporator, refrigerating capacity and COP can be maximized, and a refrigerating apparatus can be obtained which can be utilized more effectively for cooling operation by the cooling-load device.

As has been described in the forgoing, according to the invention, a vapor compression refrigerating cycle, control methods thereof, and refrigerating apparatuses can be provided with which efficiency and advantage can be realized which are superior than those of the conventional vapor compression refrigerating cycle by modifying the basic cycle for the vapor compression refrigerating cycle, that is, by converting the reversed Carnot cycle as a basic cycle of the vapor compression refrigerating cycle to the reversed Ericsson cycle as a basic cycle of the vapor compression refrigerating cycle.

BEST MODE FOR CARRYING OUT THE INVENTION

An embodiment of the present invention will now be detailed with suitable reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
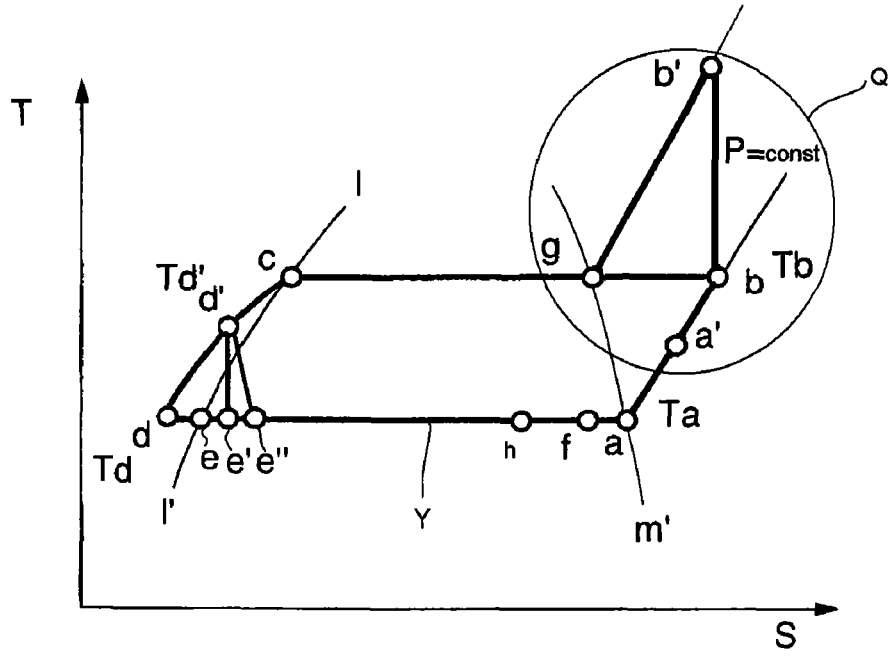
FIG. 1 is a T-S diagram of the vapor compression Ericsson refrigerating cycle according to the present invention.
Figure 2:
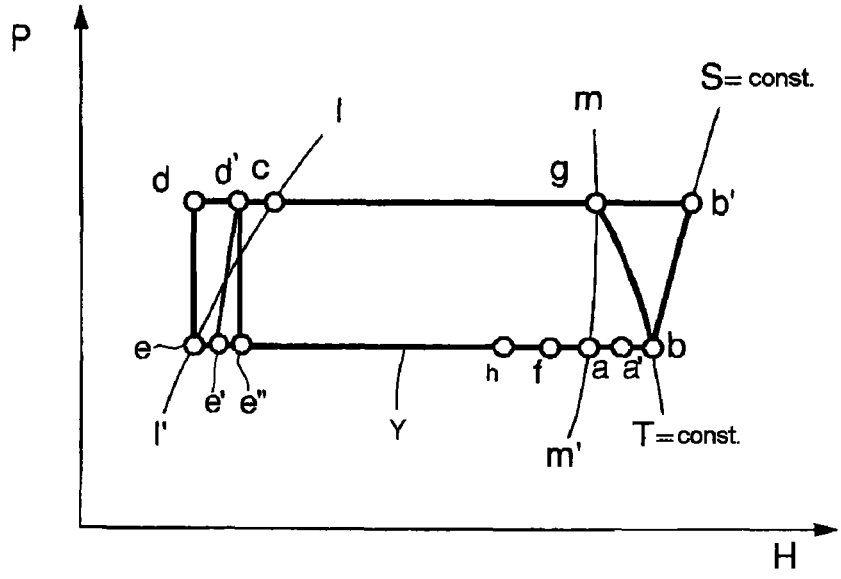
FIG. 2 is a P-H diagram of FIG. 1.
Figure 3:
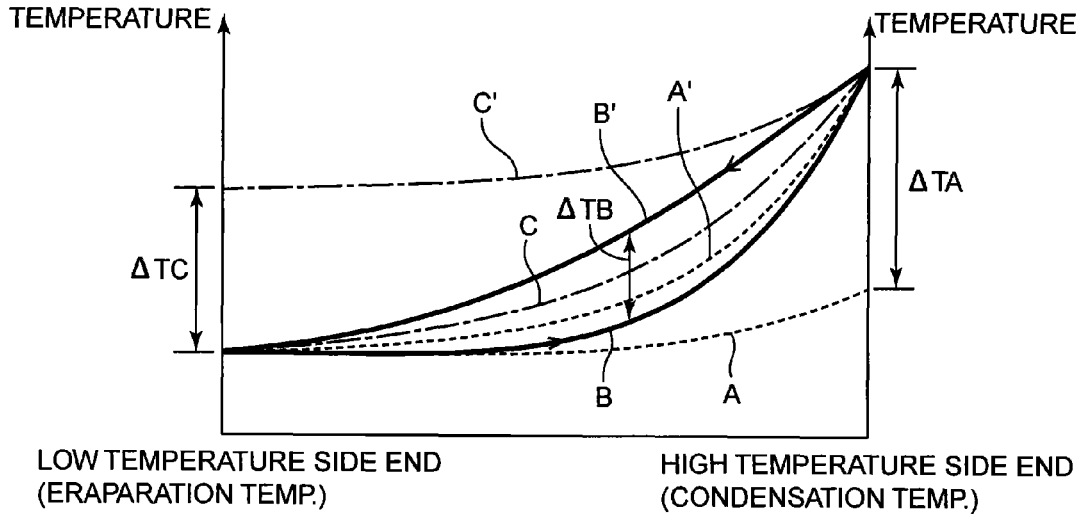
FIG. 3 is a graph showing liquid side temperature changes and vapor side temperature changes in a regeneration heat exchanger.
Figure 4:
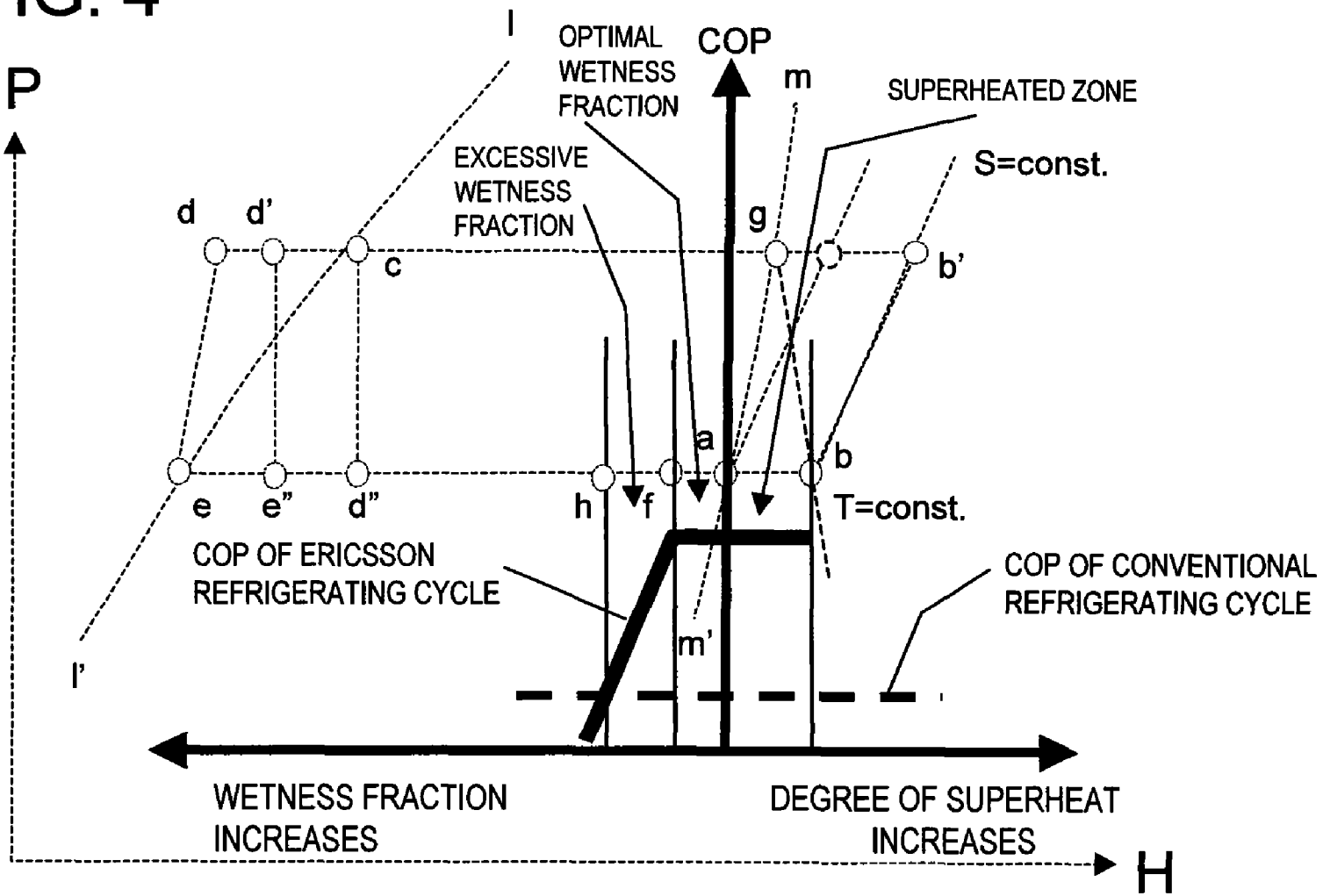
FIG. 4 is a graph showing a relation between dryness and COP and refrigerating capacity in the vapor compression Ericsson refrigerating cycle according to the present invention.
Figure 5:
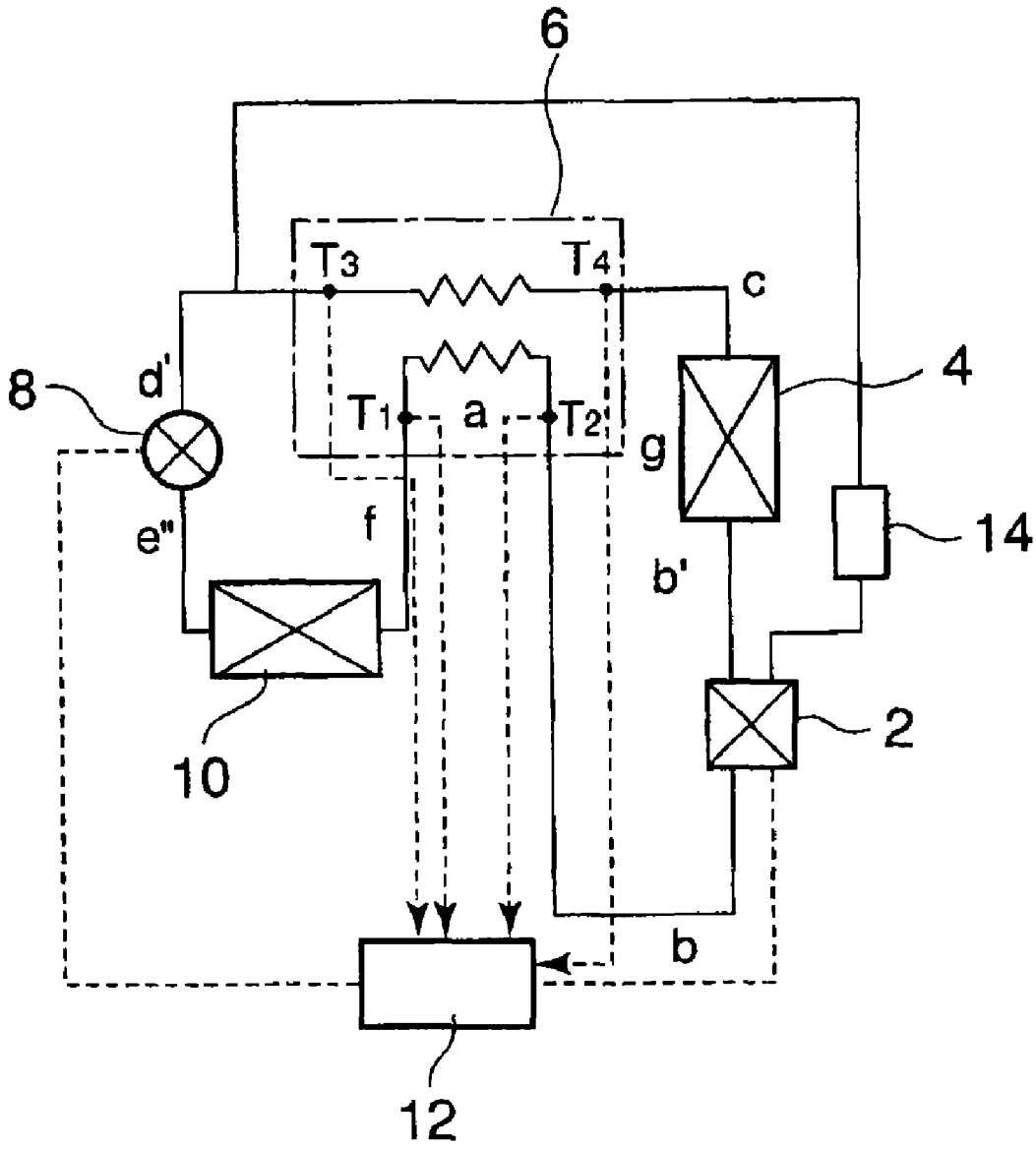
FIG. 5 is a schematic representation of an embodiment of the refrigerating cycle of the present invention.
Figure 6:
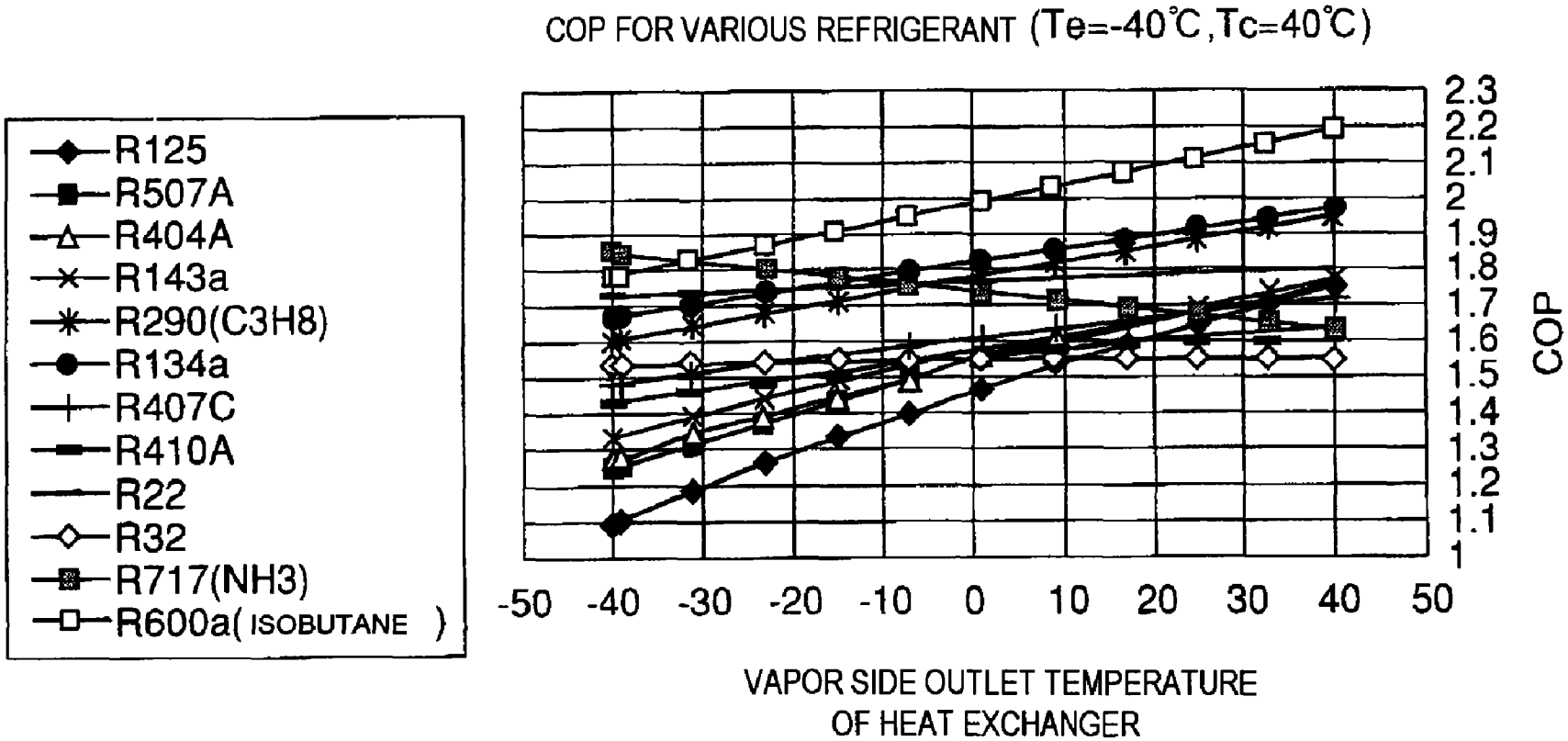
FIG. 6 is a graph showing the change in COP for a variety of refrigerants when vapor side outlet temperature in the regeneration heat exchanger.
Figure 7:
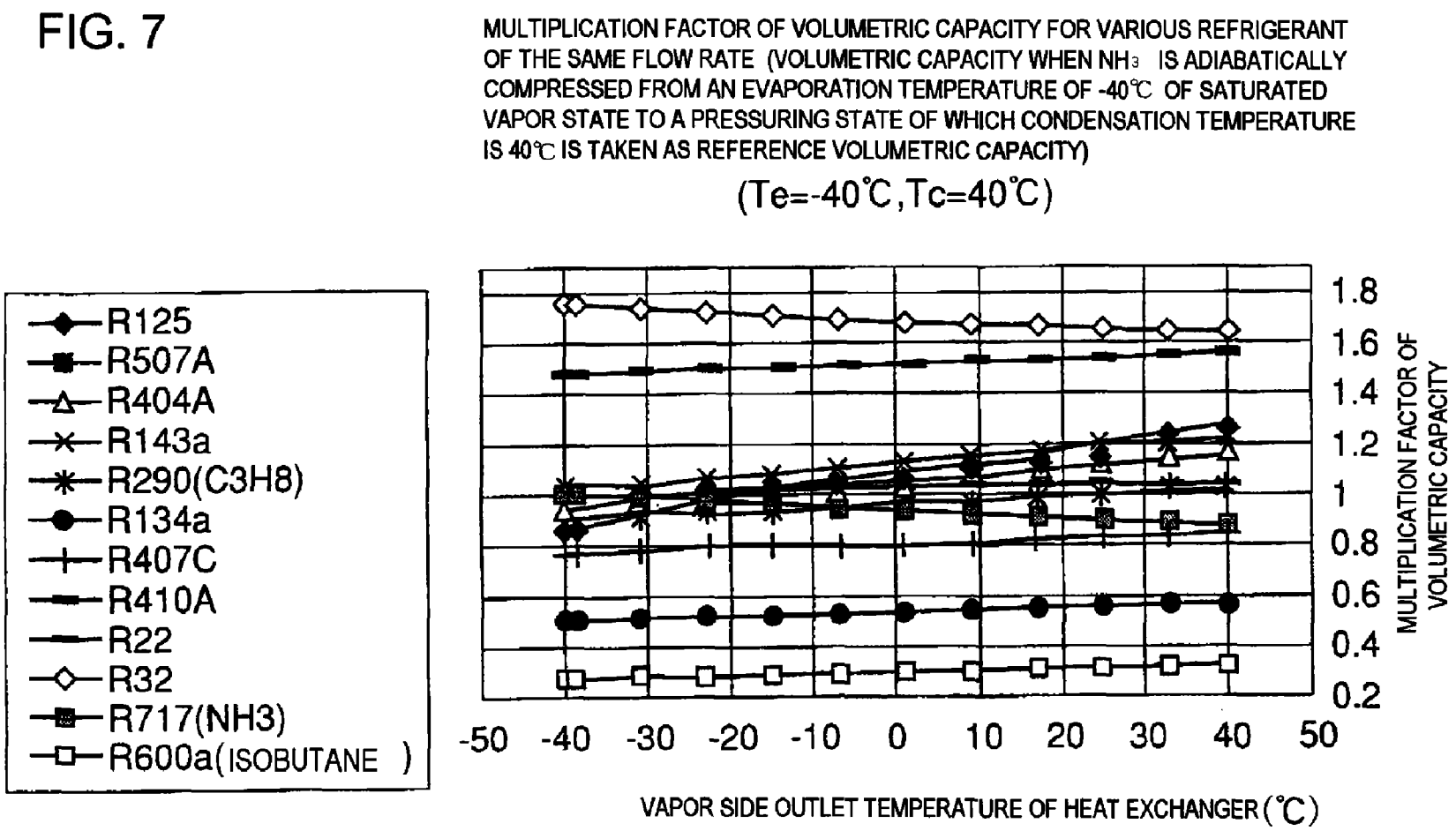
FIG. 7 is a graph showing the change in volumetric capacity for a variety of refrigerants when vapor side outlet temperature in the regeneration heat exchanger.
Figure 8:
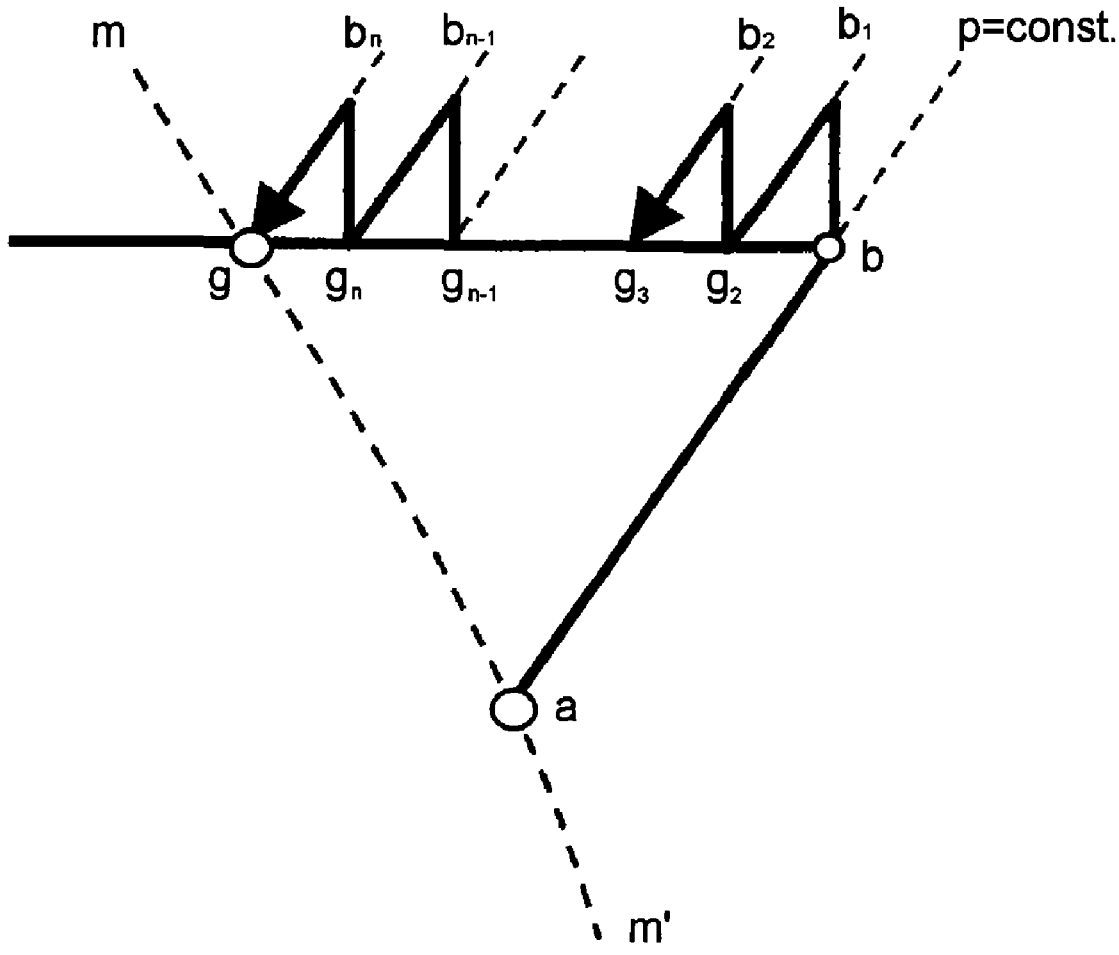
FIG. 8 is an enlarged illustration of part Q in FIG. 1.

FIGS. 1-12 used for explaining the embodiments of the invention are as follows: FIG. 1 is a T-S diagram of the vapor compression refrigerating cycle according to the present invention, and FIG. 2 is a P-H diagram of FIG. 1. FIG. 3 is a graph showing liquid side temperature changes depending on dryness of vapor refrigerant and vapor side temperature changes depending on cooling degree of liquid refrigerant in a regeneration heat exchanger. FIG. 4 is a graph showing a relation between dryness and COP and refrigerating capacity in the vapor compression Ericsson refrigerating cycle according to the present invention. FIG. 5 is a schematic representation of an embodiment of the refrigerating cycle of the present invention. FIG. 6 is a graph showing the change in COP for a variety of refrigerants when vapor side outlet temperature in the regeneration heat exchanger. FIG. 7 is a graph showing the change in volumetric capacity for a variety of refrigerants when vapor side outlet temperature in the regeneration heat exchanger. FIG. 8 is an enlarged illustration of part Q in FIG. 1 in which an example of a part b-g of isothermal process b-c is shown. FIGS. 9-12 are schematic illustrations for explaining embodiments of the refrigerating apparatus of the present invention.

In FIG. 1 is shown the T-S diagram of the vapor compression Ericsson refrigerating cycle according to the present invention with heavy lines, and the composition of the cycle is shown in FIG. 5. As shown in FIG. 5, the vapor compression refrigerating cycle according to the present invention comprises a compressor 2 for compressing a refrigerant, a condenser 4 for cooling the high-pressure refrigerant pressurized by the compressor, a countercurrent heat exchanger (regeneration heat exchanger) 6 for further cooling the refrigerant cooled in the condenser 4, an expansion valve (expansion means) 8 for depressurizing the refrigerant, and a evaporator 10 for achieving wanted cooling.

Further the cycle is provided with a cycle controller (control means) 12 for controlling the actuation of the expansion valve 8 and the compressor 2 so that the refrigerant at the exit of the evaporator 10 is at a temperature at which the refrigerant is in a prescribed state, i.e. in a state of prescribed dryness, based on the actuation state of the expansion valve 8 and compressor 2 and the temperature of the refrigerant at the exit of the evaporator 10.

Furthermore, the compressor 2 is provided with a liquid injection means 14 for properly controlling the temperature of the refrigerant at the exit of the compressor 2 by injecting a part of liquid refrigerant into the compressor 2 drawn from a part between the exit of liquid refrigerant of the heat exchanger 6 and the inlet of the expansion valve.

In FIG. 5 showing the system composition are entered symbols a, b, b', g, c, d', e", and a showing state points of refrigerant in T-S diagram of FIG. 1. Process d'-e" is isenthalpic expansion when an expansion valve 8 is provided as an expansion means.

The vapor compression Ericsson cycle a-b-b'-g-c-d'-e' (e")-a is based on the theoretical vapor compression Ericsson cycle a-b-c-d-a.

This reversed Ericsson cycle a-b-c-d-a operates overstriding the dry saturated vapor mm' and saturated liquid line ll'.

Process a-b is reversible isobaric heat absorption, process b-c is reversible isothermal compression, process c-d is reversible isobaric heat dissipation, and process d-a is reversible isothermal expansion. The isobaric heat dissipation process c-d is in the liquid range, i.e. left side from the saturated liquid line. The isobaric heat absorption process a-b is in the superheated vapor range, i.e. right side from the dry saturated vapor line. A large part of the isothermal compression process (high-temperature side isothermal process) b-c consists of condensation process, and a large part of the isothermal expansion (low-temperature side isothermal process) d-a consists of evaporation process.

Isothermal process b-c consists of a partial process b-g and a partial process g-c, in which the partial process b-g is isothermal compression process, and the partial process g-c is isothermal condensation process.

In the present state of the art, no practical isothermal compressor superior to an adiabatic compressor is available, so isothermal compression process b-g is substituted by adiabatic compression process in the case of the vapor compression refrigerating cycle of the present invention. That is, the reversible isothermal compression process b-g is replaced by the reversible adiabatic compression process b-b' and reversible isothermal heat dissipation process b'-g. The compressor 2 in FIG. 5 performs the reversible adiabatic compression process b-b'.

As to isothermal process part d-e in FIG. 1, the change in volume of refrigerant is very small, for liquid refrigerant experience the process, and the refrigerant experience a wide range of change of state, although point d and e is very near to each other in the T-S diagram. In the P-H diagram of FIG. 2, the isothermal expansion process d-e contains a wide range of process that can be assumed approximately an isenthalpic process. Therefore, practically the expansion valve 8 can be substituted for an isothermal expansion device to perform the isothermal process d-e without significant reduction in refrigerating capacity.

The cycle control means 12 shown in FIG. 5 controls the flow through the expansion valve 8 and the flow through the compressor 2. Flow control of the compressor 2 is determined depending on operation condition and load condition. Flow control of the expansion valve 8 is done as follows:

Four temperature sensors are located at vapor side inlet and outlet and liquid side inlet and outlet of the heat exchanger 6 respectively, and vapor side inlet temperature T1 and outlet temperature T2, and liquid side inlet temperature T4 and outlet temperature T3 are detected.

FIG. 3 is a graph showing liquid side temperature changes and vapor side temperature changes in the regeneration heat exchanger 6.

There may occur three states of refrigerant vapor at the entrance to the heat exchanger 6, i.e. state of too small dryness (excessive wetness fraction), optimal dryness (optimal wetness fraction), and excessive dryness (too small wetness fraction).

In the graph of FIG. 3 are shown vapor side and liquid side temperature change when the dryness is too small (excessive wetness fraction) by a curve A (broken line) and curve A' (broken line) respectively, vapor side and liquid side temperature change when the dryness is optimal (optimal wetness fraction) by a curve B (solid line) and curve B' (solid line) respectively, and vapor side and liquid side temperature change when the dryness is excessively large (too small wetness fraction) by a curve C (chain line) and curve C' (chain line) respectively.

Dryness of refrigerant vapor at the inlet to the heat exchanger 6 is controlled by controlling the flow rate of the high-pressure refrigerant passing through the expansion valve 8 based on detected temperatures T1~T4 shown in FIG. 5.

The flow rate of the refrigerant passing through the heat exchanger 6 is feedback-controlled based on detected temperatures T1~T4 by reducing flow rate of the high-pressure liquid refrigerant passing through the expansion valve 8 when dryness is too small (wetness fraction is excessive) as shown by the curve A, A', that is, when temperature difference ⊿TA at high-temperature side exceeds a prescribed value (liquid inlet temperature T4−vapor outlet temperature T2>prescribed value (for example 5° C.)) and increasing flow rate of the high-pressure liquid refrigerant passing through the expansion valve 8 when dryness is excessive (wetness fraction is insufficient) as shown by the curve C, C', that is, when temperature difference ⊿TC at low-temperature side exceeds a prescribed value (liquid outlet temperature T3−vapor inlet temperature T1>prescribed value (for example 5° C.)) so that both the temperature differences at the high-temperature side and low-temperature side of the heat exchanger 6 are kept within a prescribed value (for example 5° C.). By this, dryness of the refrigerant vapor at the vapor inlet of the heat exchanger 6 can be maintained to be near proper dryness (or wetness) fraction as shown by curve B (unless the prescribed value of temperature difference is zero, temperature change runs near along the curve B).

As shown in FIG. 1 and FIG. 5, when vapor side inlet temperature T1 is equal to a dry saturated vapor temperature Ta, and the state of refrigerant at the liquid side outlet is at a point d' when vapor side outlet temperature T2 is equal to a condensation temperature Tb.

The point d' is a state point at which enthalpy difference is; $\Delta Hba=\Delta Hcd'$, and the point d is a state point at which enthalpy difference is; $\Delta Hbf=\Delta Hcd$. Temperatures at point d' and d are respectively Td' and Td.

Refrigerating capacity of the cycle when the state of refrigerant at the vapor side inlet is shifted from the dry saturated vapor at point a to point f at which the refrigerant is in a wet vapor state, and further shifted beyond point a, f will be investigated hereunder with reference to FIG. 1, FIG. 2, FIG. 4, and FIG. 5.

Relations between enthalpies of the refrigerant at each state point are shown by equations (1)-(13) as already shown. It was recognized as shown in FIG. 4 that even if dryness changes in the section between point a and point f at vapor side inlet of the heat exchanger 6, refrigerating capacity is always increase by $Hb-Ha(=\Delta Hba)$; in a zone where dryness is larger than that of at point f, refrigerating capacity decrease as shown at point h; and in a superheated vapor zone beyond point f, the maximum value in the section a-f is extended when heat amount of the superheated vapor is effectively utilized.

By the way, the reasons that the point f is the optimum point in spite of the fact that refrigerating capacity is unchanged in the section a-f, is that dryness is the smallest (wetness fraction is the largest) at the point f in the section a-f, so degree of cooling of the refrigerant liquid is largest and generation of flash gas at the expansion through the expansion valve is the smallest (zero or extremely small), that is, volume change by expansion is the smallest and the occurrence of corrosion/erosion of the expansion valve by the flash gas is prevented, that dryness after expansion decrease (wetness fraction increases), so heat transfer coefficient in the evaporator increases and heat loss in the evaporator decreases, etc.

In FIG. 4 is shown a relation between dryness and COP and refrigerating capacity in the vapor compression Ericsson refrigerating cycle according to the present invention. In the range of the section a-f, COP is constant, because refrigerating capacity does not change in spite of different refrigerant state at the point f at the vapor side inlet of the regeneration heat exchanger from that at the point a, and, as refrigerant state at inlet of the compressor is the point b in FIG. 1, the power for compression is constant.

That COP is equal to COP of the typical conventional vapor compression refrigerating cycle at point h in FIG. 4 will be explained hereunder. In the drawing, a typical vapor compression refrigerating cycle based on the reversed Carnot cycle a-b-g-c-d" is shown in the P-H diagram of FIG. 4, and also the cycle a-b-b'-g-c-d-e-a (in the case of isothermal expansion) according to the invention is shown in broken lines, and explanation will be done also referring to these lines. When dryness is allowed to decrease (wetness fraction to increase) in the section f-h, vapor outlet temperature in the regeneration heat exchanger changes from the point b toward the point a. On the other hand, the state of outlet liquid refrigerant in the heat exchanger remains unchanged at point d. When dryness at the vapor inlet in the regeneration heat exchanger reaches the state point h, state at the inlet of the compressor comes to the point a, and increase (ΔHba) of the refrigerating capacity becomes zero. That is, in this case, operating condition is completely the same as that of the typical conventional vapor compression refrigerating cycle. Therefore, for the same compressor, when refrigerant vapor sucked by the compressor is in the state of the state point h, refrigerating capacity and COP of this cycle is the same as those of the conventional cycle. As COP is constant and at its maximum when the state of refrigerant at the vapor side inlet of the heat exchanger is between the section f-a, relation of refrigerating capacity and COP in the section f-h have rightward rising tendency.

Therefore, here denoting dryness at the vapor side inlet of the heat exchanger by X, by controlling the dryness to range from dryness at the state point h, X=Xh, with which the state of the refrigerant vapor at the vapor side outlet of the heat exchanger is in its dry saturated vapor state (refrigerant vapor at the outlet is in a state of dry saturated vapor when the refrigerant vapor at the outlet is in a state of dry fraction of Xh), to dryness at the state point a, i.e. X=1, with which the temperature of the refrigerant vapor at the vapor side outlet of the heat exchanger is at the condensation temperature in the condenser, i.e. $Xh \leqq X \leqq 1$ refrigerating capacity and COP can be increased compared with those of the typical conventional vapor compression refrigerating cycle.

Next, results of calculation of how COP of the refrigerating cycle varies depending on dryness of refrigerant vapor at the vapor side inlet of the heat exchanger are shown in FIG. 6 and FIG. 7 for a variety of refrigerants based on their physical properties.

Here, compression power W is calculated by the following equation (4), and specific heat and specific heat ratio of refrigerant at 80° C. are used assuming discharge temperature from the compressor to be about 80° C. This corresponds to the case oil injection type screw compressors and all kind of liquid injection type compressors are operated so that discharge temperature is about 80° C.

$$W=K/(K-1)(P_1V_1)[(P_2/P_1)^{(x-1)/x}-1] \quad (14)$$

where K=specific heat ratio of refrigerant vapor, $P_1$=suction pressure, $P_2$=discharge pressure, and $V_1$=volume flow rate of refrigerant vapor.

In FIG. 6 and FIG. 7, abscissas represent vapor side outlet temperature in the regeneration heat exchanger. The ordinate in FIG. 6 represents COP, and the ordinate in FIG. 7 represents factors of multiplication of volumetric capacity. Calculation was carried out with evaporation temperature (Te) of refrigerant of −40° C., condensation temperature (Tc) of refrigerant of 40° C., and kinds of refrigerant as parameters. Volumetric capacity (kJ/m$^3$) is refrigerating capacity (kW) per unit volume flow rate (m$^3$/s) of refrigerant in compressor, and the factor of multiplication means the ratio of the volumetric capacity of this cycle to that when ammonia refrigerant is adiabatically compressed from an evaporation temperature of −40° C. of saturated vapor state to a pressurized state at which condensation temperature is 40° C.

Abscissas in both Figures mean that when temperature of the abscissa is −40° C., dryness of the vapor at the vapor side inlet of the regeneration heat exchanger is deficient (excessive in wetness fraction), that is, this state corresponds to the point h in FIG. 4, and vapor side outlet temperature is −40° C. (i.e. suction temperature of the compressor is −40° C.).

Similarly, when temperature of the abscissa is −40° C., dryness of the vapor at the vapor side inlet of the regeneration heat exchanger is that of a state between the state point a and f in FIG. 4, and vapor side outlet temperature is 40° C. That vapor side outlet temperature is between both the temperature means that dryness of the vapor at the vapor side inlet is deficient (excessive in wetness fraction).

From FIG. 6 and FIG. 7 can be recognized the following:

Among refrigerants shown in FIG. 6 and FIG. 7, COP of this cycle decreases as vapor side outlet temperature in the heat exchanger increases only when ammonia refrigerant (R717) is used. From this, it is recognized that ammonia is a refrigerant inappropriate for this cycle. COP is improved by applying this cycle with all the refrigerants shown in FIG. 6, 7 except ammonia. As to volumetric capacity, it increases as vapor side outlet temperature in the heat exchanger increases by applying this cycle with all of the refrigerants shown in FIG. 6, 7 except ammonia and R32. Volumetric capacity is largest in FIG. 7 with R32, so it is recognized that only ammonia is inappropriate for this cycle.

By operating the cycle of the invention at high COP condition, COP higher than with ammonia can be attained with R600a, R134a, and R290.

When compared in the case of compressors of the same displacement volume, refrigerating capacity larger than that obtained when operated with ammonia can be increased with any of R32, R410A, R125, R134a, R507, R404, R290, and R22.

As has been described above, refrigerating capacity and COP can be maximized by controlling dryness of the refrigerant vapor at the entrance to the regenerating heat exchanger 6.

FIG. 8 is an enlarged illustration of part Q in FIG. 1. In the drawing, an example of a partial process of process b-c, i.e. a substitution for the isothermal process b-g is shown. Condensation process of high temperature side isothermal process b-c is composed of multistage adiabatic compression processes $b\text{-}b_1$, $g_2\text{-}b_2$, . . . , $g_n\text{-}b_n$ and multistage isobaric heat dissipation processes $b_1\text{-}g_2$, $b_2\text{-}g_3$, . . . , $b_n\text{-}g$.

When the number of stages is increased infinitely, effect of adiabatic compression is eliminated and the compression process converges into an isothermal compression process, and the inlet temperature in the compression process and compression temperature become equal to condensing temperature Tb. This means that environmental temperature (temperature of the ambient air) can be used as a low temperature source needed for isothermal compression, which is very advantageous from practical point of view. The Ericsson cycle has isothermal processes and has not adiabatic processes. By applying multistage adiabatic compression processes and multistage heat dissipating processes, the processes can be approximated to an isothermal compression process under the environmental temperature, and power for compressing refrigerant can be reduced.

Next, the refrigerating apparatus according to the present invention will be explained referring to FIG. 9-FIG. 12.

FIRST EMBODIMENT

Figure 9:
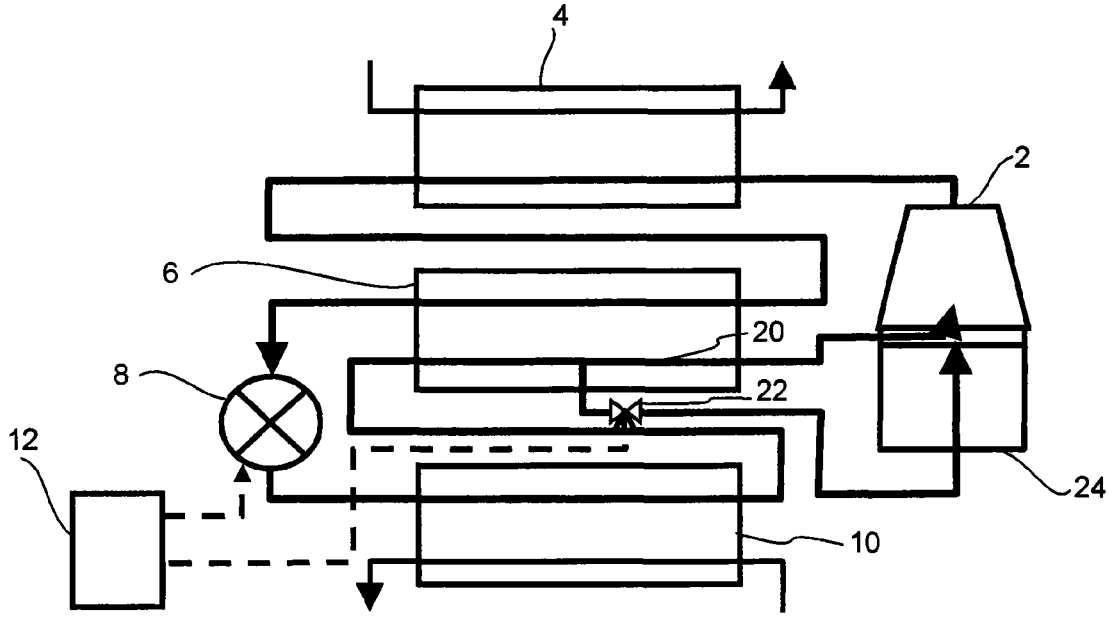
FIG. 9 is a schematic illustration for explaining the first embodiment of the refrigerating apparatus according to the present invention.

FIG. 9 is a schematic illustration for explaining the first embodiment of the refrigerating apparatus. The apparatus comprises a compressor 2 for compressing refrigerant, a condenser 4 for cooling the refrigerant compressed to high pressure, a countercurrent heat exchanger (regeneration heat exchanger) 6 for further cooling the refrigerant cooled through the condenser 4, an expansion valve (expansion means) 8, an evaporator 10 in which the refrigerant flown out from the expansion valve 8 is evaporated by absorbing heat from the ambience, and a cycle control means 12 for controlling the expansion valve and compressor 2.

A refrigerant vapor flow branched from a vapor side heat transfer path 20 in the regeneration heat exchanger 6 at a midway of the path 20 via a flow regulation valve 22 is introduced to a cooling-load device 24, and refrigerant vapor flown out form the cooling-load device 24 and flown out from the regeneration heat exchanger 6 are sucked by the compressor 2. The cooling-load device 24 is composed of a hermetic motor which is integrated in the compressor 2 for refrigerating/air conditioning.

According to the apparatus of the first embodiment, the cooling-load device 24 can be cooled by utilizing the increment (ΔHba) of refrigerating capacity gained by the refrigerating cycle applying the inversed Ericsson cycle of the invention. Further, the apparatus is better fitted for maintaining the cooling-load device 24 to a temperature near that of condensing temperature Tb, for refrigerant diverted from the heat transfer path 20 in the regeneration heat exchanger 6 is introduced to the cooling-load device 24 via the flow regulation valve 22.

Further, dryness X of refrigerant vapor at the inlet of the regeneration heat exchanger 6 is controlled in a range from Xh with which the state of the refrigerant vapor at the vapor side outlet is in its dry saturated vapor state and X=1 with which the temperature of the refrigerant vapor at the vapor side outlet is at the condensation temperature of the refrigerant in the condenser, that is, $Xh \leqq X \leqq 1$, by the control means 12. By controlling like this, refrigerating capacity and COP can be increased compared with the conventional vapor compression refrigerating cycle.

Further, the control means 12 controls by means of the flow regulation valve 22 the flow rate of refrigerant flowing to the cooling-load device 24 which is a hermetic motor so that the temperature of the refrigerant at the outlet of the hermetic motor is maintained near the condensing temperature in the condenser 4. In this way, the refrigerating apparatus of the invention can be operated so that refrigerating capacity and COP are at its maximum.

In the following embodiments, it is also necessary to keep the temperature of refrigerant at the inlet of the compressor 2 always near the temperature of the condensing temperature.

SECOND EMBODIMENT

Figure 10:
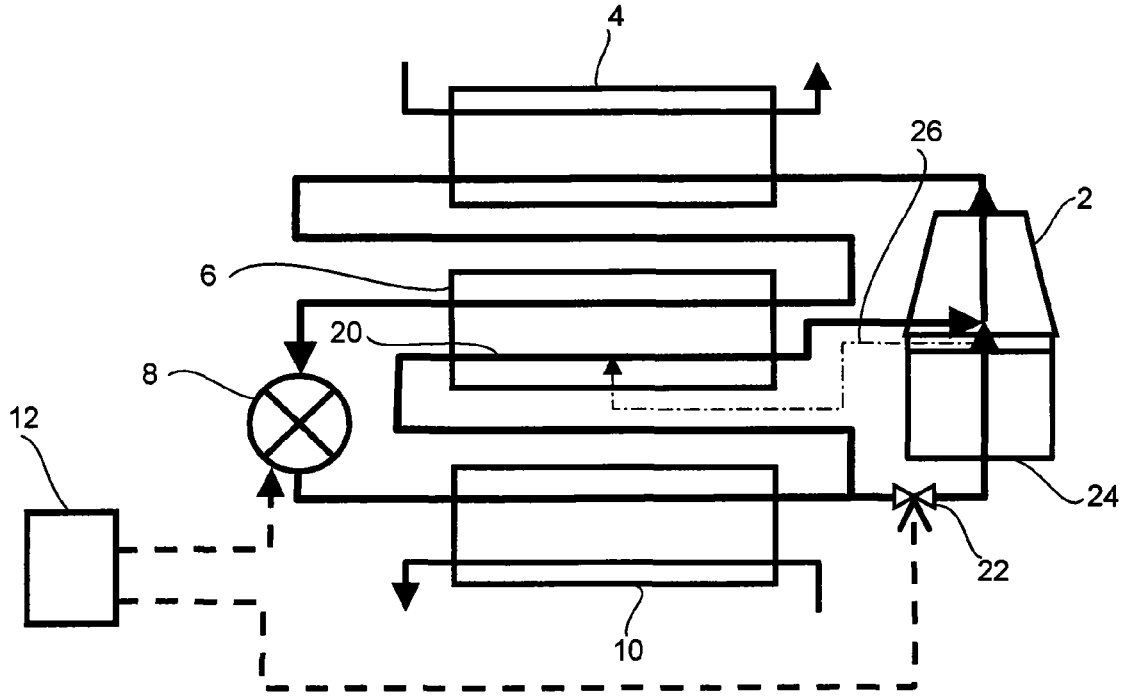
FIG. 10 is a schematic illustration for explaining the second embodiment of the refrigerating apparatus according to the present invention.

FIG. 10 is a schematic illustration for explaining the second embodiment of the refrigerating apparatus. The vapor compression refrigerating shown in FIG. 10 is similar to that of FIG. 9. This embodiment is characterized in that a part of refrigerant vapor flowing out from the evaporator 10 is diverted via a flow regulation valve 22 to be introduced to the cooling-load device 24 and the refrigerant vapor flowing out from the cooling-load device 24 is returned to a midway along the vapor side heat transfer path 20 in the regeneration heat exchanger 6 via a return path 26 or returned to the outlet of the regeneration heat exchanger 6 for refrigerant vapor to be introduced to the compressor 2 together with refrigerant vapor flowing out from the regeneration heat exchanger 6. The cooling-load device 24 is composed of a hermetic motor which is integrated in the compressor 2 for refrigerating/air conditioning.

According to the second embodiment, the cooling-load device 24 can be cooled by utilizing the increment (ΔHba) of refrigerating capacity gained by the refrigerating cycle applying the inversed Ericsson cycle of the invention as is with the first embodiment. Furthermore, the apparatus of this embodiment is better suited for maintaining the cooling-load device to still lower temperature, for apart of the refrigerant flowing out from the evaporator 10 is diverted to be introduced to the cooling-load device 24 directly and the cooling-load device can be cooled effectively.

THIRD EMBODIMENT

Figure 11:
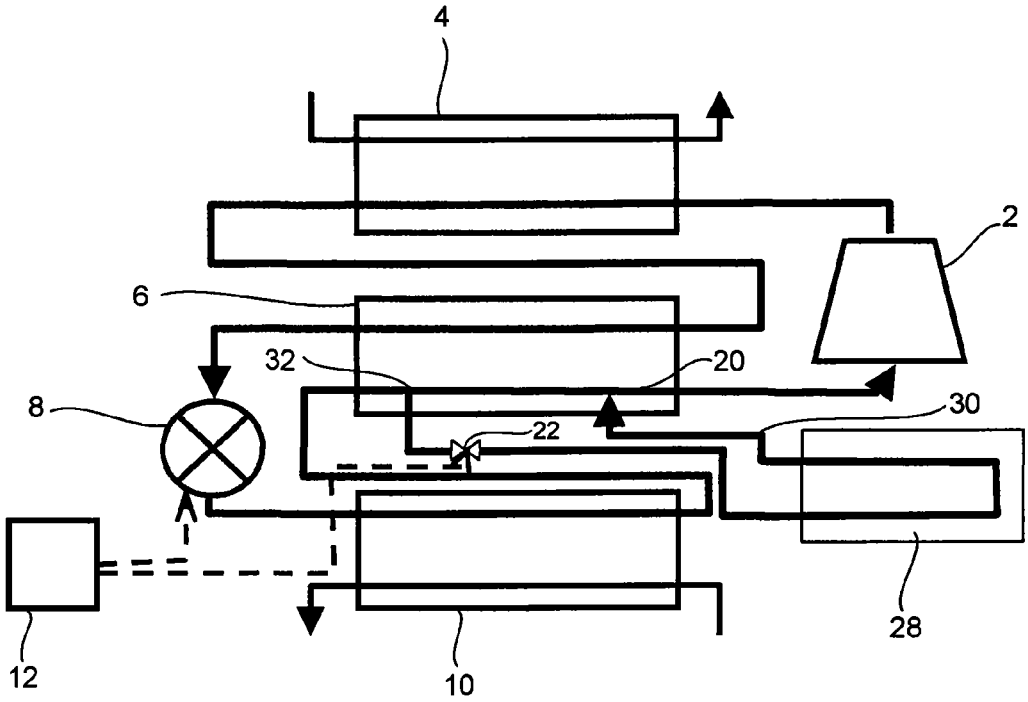
FIG. 11 is a schematic illustration for explaining the third embodiment of the refrigerating apparatus according to the present invention.

FIG. 11 is a schematic illustration for explaining the third embodiment of the refrigerating apparatus. The vapor compression refrigerating shown in FIG. 11 is the similar to that of FIG. 9. This embodiment is characterized in that refrigerant vapor flow branched from a vapor side heat transfer path 20 in the regeneration heat exchanger 6 at a midway (at a position 32) of the path 20 via a flow regulation valve 22 is introduced to a cooling-load device 28, and refrigerant vapor flowing out from the cooling-load device 28 is introduced to the heat transfer path 20 at a position downstream from the position 32 from which refrigerant was diverted via a return path 30. The cooling-load device 28 is a generally used cooling-load device for cooling a preparatory cooling room and anterior room of a cold store, for air-conditioning a storage room, etc.

According to the third embodiment, the cooling-load device 28 can be cooled by utilizing the increment (ΔHba) of refrigerating capacity gained by the refrigerating cycle applying the inversed Ericsson cycle of the invention as is with the first embodiment. Further, with this embodiment, refrigerant diverted at the branch point 32 is flown through the cooling-load device 28 and then all the refrigerant flown through the cooling-load device 28 is returned again to the regeneration heat exchanger 6 from which then introduced to the inlet of the compressor 2, so refrigerant vapor is returned to the compressor 2 after sufficiently adjusted in temperature in the regeneration heat exchanger 6. Therefore, compared with the first and second embodiments in which the diverted refrigerant interflows into the refrigerant flow from the regeneration heat exchanger 6 at the inlet of the compressor 2, temperature of refrigerant can be adjusted in a wider range and a wide range of temperatures of cooling loads from evaporation temperature in the evaporator 10 to condensing temperature in the condenser can be accommodated to by the apparatus of the embodiment.

FOURTH EMBODIMENT

Figure 12:
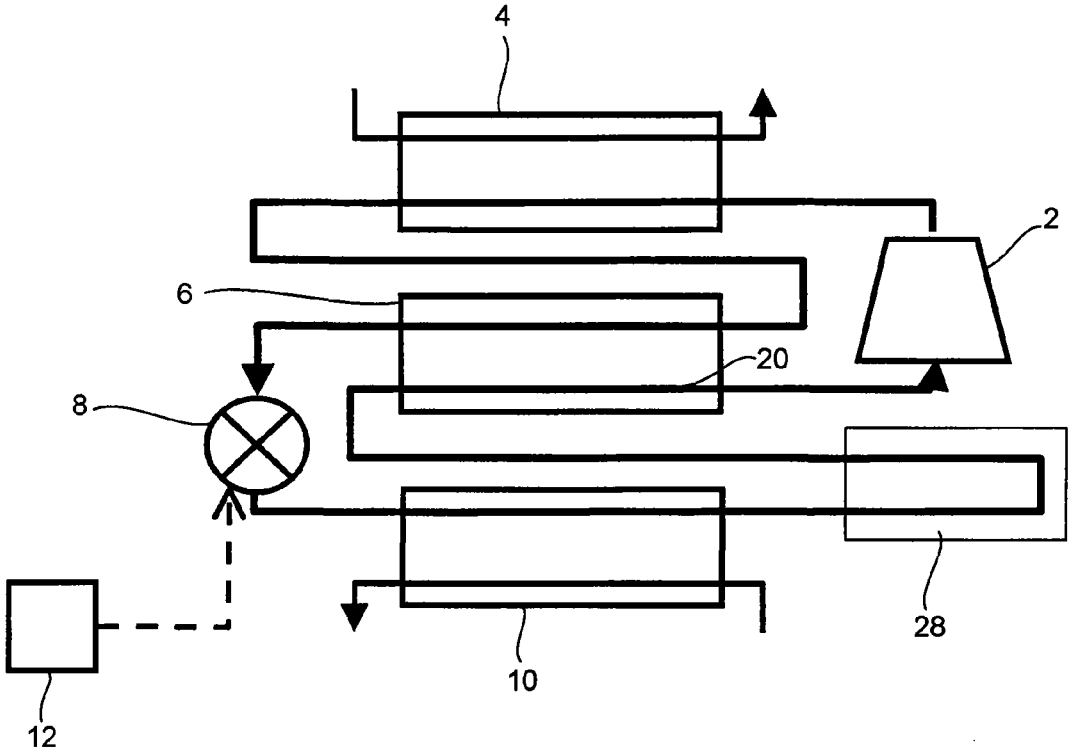
FIG. 12 is a schematic illustration for explaining the fourth embodiment of the refrigerating apparatus according to the present invention.
Figure 13:
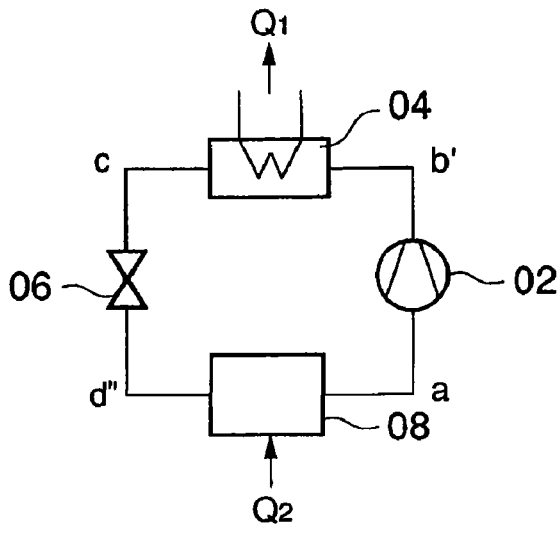
FIG. 13 is a schematic representation of a typical vapor compression refrigerating cycle.
Figure 14:
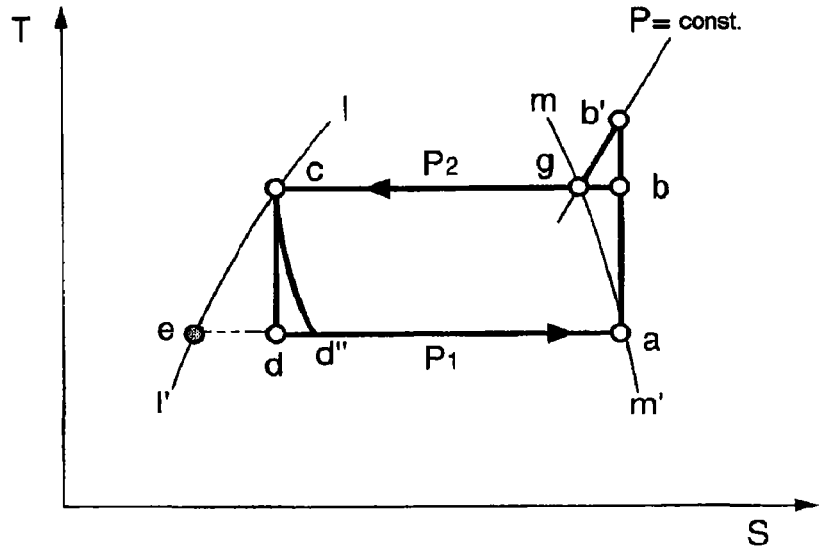
FIG. 14 is a T-S diagram of FIG. 13.
Figure 15:
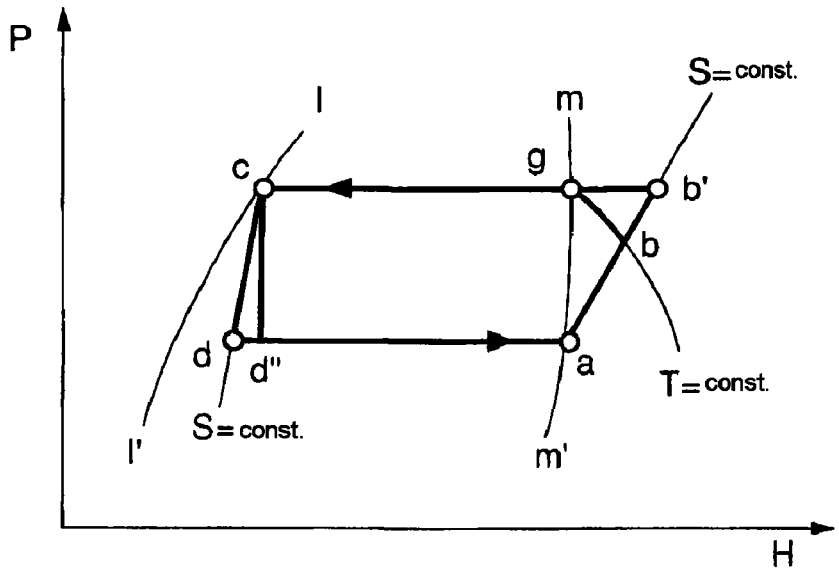
FIG. 15 is a P-H diagram of FIG. 14.
Figure 16:
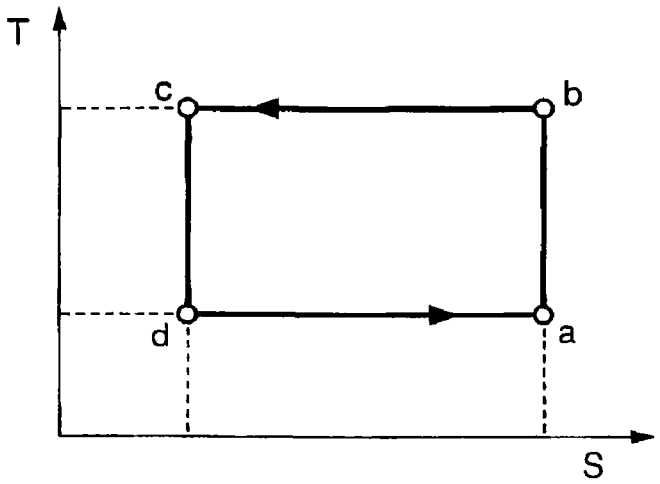
FIG. 16 is a T-S diagram of the reversed Carnot cycle.
Figure 17:
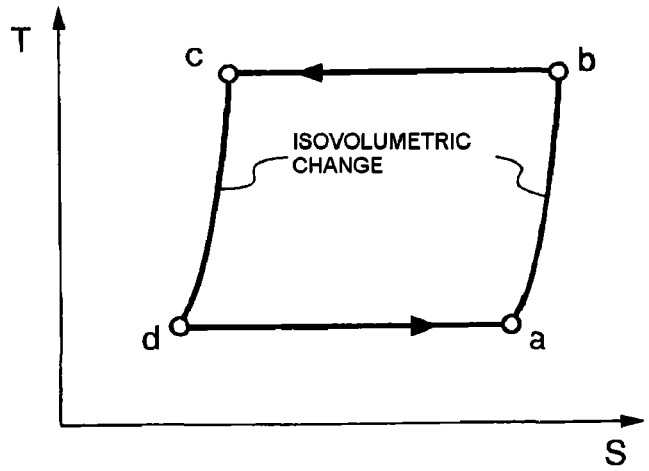
FIG. 17 is a T-S diagram of the reversed Stirling cycle.
Figure 18:
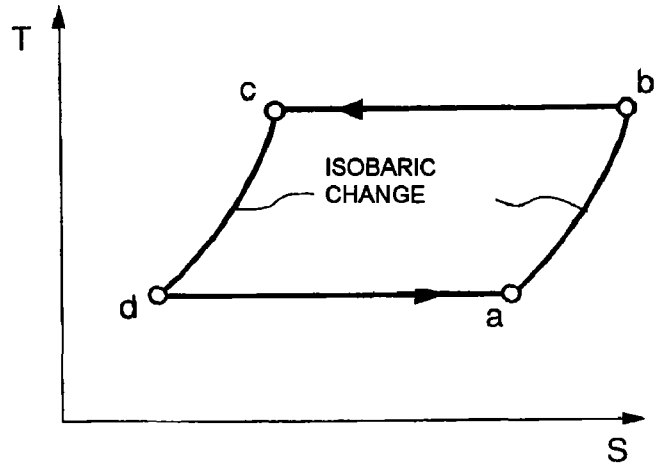
FIG. 18 is a T-S diagram of the reversed Ericsson cycle.

FIG. 12 is a schematic illustration for explaining the third embodiment of the refrigerating apparatus. The vapor compression refrigerating shown in FIG. 12 is the similar to that of FIG. 9. This embodiment is composed such that all of refrigerant vapor flowing in the evaporator 10 is introduced into the cooling-load device 28, and all of refrigerant vapor flowing out from the cooling-load device 28 is introduced to heat transfer path 20 in the refrigeration heat exchanger 6 and then introduced to the inlet of the compressor. The cooling-load device 28 is a generally used cooling-load device for cooling a preparatory cooling room and anterior room of a cold store, for air-conditioning a storage room, etc.

According to the fourth embodiment, as dryness of refrigerant at vapor side inlet is controlled by controlling the flow rate regulation valve 8 by the control means 12 so that dryness is in the range between dryness at the state point Xh, with which the state of the refrigerant vapor at the vapor side outlet of the heat exchanger is in its dry saturated vapor state (refrigerant vapor at the outlet is in a state of dry saturated vapor when the refrigerant vapor at the outlet is in a state of dry fraction of Xh), and dryness at the state point a, i.e. $X=1$, with which the temperature of the refrigerant vapor at the vapor side outlet of the heat exchanger is at the condensation temperature in the condenser, i.e. $Xh \leqq X \leqq 1$, the apparatus of this embodiment can accommodate to a variety of cooling-load device 28 for cooling to a relatively low temperature range near that of evaporation temperature in the evaporator 10, and refrigerating system can be simplified.

INDUSTRIAL APPLICABILITY

By the vapor compression refrigerating cycle, control methods thereof, and refrigerating apparatuses according to the present invention, efficiency and advantage can be realized which are superior than those of the conventional vapor compression refrigerating cycle by modifying the basic cycle for the vapor compression refrigerating cycle, that is, by converting the reversed Carnot cycle as a basic cycle of the vapor compression refrigerating cycle to the reversed Ericsson cycle as a basic cycle of the vapor compression refrigerating cycle. The present invention can be applied advantageously to refrigerating apparatuses, air conditioners, etc.

The invention claimed is:

1. A vapor compression refrigerating cycle apparatus comprising:

a compressor, a condenser, a regeneration heat exchanger, an expansion device, and an evaporator connected in series;

an injection device that injects liquid refrigerant; and a controller that controls refrigerating capacity, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, wherein process part occurring in a superheated vapor zone of the isothermal heat dissipation process in the reversed Ericsson cycle is substituted by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition, wherein part of the isobaric heat dissipation process in the liquid zone is carried out in the regeneration heat exchanger by releasing heat from refrigerant liquid in the liquid zone to refrigerant vapor entering the compressor, wherein remaining process part of the isobaric heat dissipation process in the liquid zone is substituted by isenthalpic or isentropic expansion, the expansion being carried out by the expansion device, and expanded refrigerant is introduced to the evaporator to carry out isothermal and isobaric heat absorption and then to be sucked into the compressor, wherein the regeneration heat exchanger is located so that its vapor side is between the evaporator and the compressor, and its liquid side is between the condenser and the expansion means device, wherein the controller controls the refrigerating capacity by controlling dryness of refrigerant vapor entering the vapor side of the regeneration heat exchanger, and wherein the injection device injects part of the liquid refrigerant introduced from part between a liquid outlet of the regeneration heat exchanger and an inlet of the expansion device into the compressor to control refrigerant temperature at an outlet of the compressor to be a prescribed temperature.

2. A vapor compression refrigerating cycle apparatus comprising:

a compressor, a condenser, a regeneration heat exchanger, an expansion device, and an evaporator connected in series;

an injection device that injects liquid refrigerant; and a controller that controls refrigerating capacity, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, wherein process part occurring in a superheated vapor zone of the isothermal heat dissipation process in the reversed Ericsson cycle is substituted by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition, wherein part of the isobaric heat dissipation process in the liquid zone is carried out in the regeneration heat exchanger by releasing heat from refrigerant liquid in the liquid zone to refrigerant vapor entering the compressor, wherein remaining process part of the isobaric heat dissipation process in the liquid zone is substituted by isenthalpic or isentropic expansion, the expansion being carried out by the expansion device, and expanded refrigerant is introduced to the evaporator to carry out isothermal and isobaric heat absorption and then to be sucked into the compressor, wherein the regeneration heat exchanger is located so that its vapor side is between the evaporator and the compressor, and its liquid side is between the condenser and the expansion device, wherein the controller controls the refrigerating capacity by controlling dryness of refrigerant vapor entering the vapor side of the regeneration heat exchanger, and wherein the adiabatic compression process and the isobaric heat dissipation process substituted for the process part occurring in the superheated zone of the high temperature side isothermal heat dissipation process of the reversed Ericsson cycle is composed of multistage adiabatic compression process and multistage isobaric heat dissipation process.

3. A method of controlling a vapor compression refrigerating cycle apparatus comprising a compressor, a condenser, a regeneration heat exchanger, an expansion device, and an evaporator connected in series, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, the method comprising the steps of:

substituting process part occurring in a superheated vapor zone of the isothermal heat dissipation process in the reversed Ericsson cycle by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition;

executing part of the isobaric heat dissipation process in the liquid zone in the regeneration heat exchanger by releasing heat from refrigerant liquid in the liquid zone to refrigerant vapor entering the compressor;

substituting remaining process part of the isobaric heat dissipation process in the liquid zone with isenthalpic or isentropic expansion, the expansion being carried out by the expansion device, and introducing expanded refrigerant to the evaporator to carry out isothermal and isobaric heat absorption and then to be sucked into the compressor; and controlling refrigerating capacity by controlling dryness of refrigerant vapor entering the vapor side of the regeneration heat exchanger, wherein dryness X of refrigerant vapor at a vapor side inlet of the heat exchanger is controlled to be in a range between Xh with which the state of the refrigerant vapor at the vapor side outlet of the heat exchanger is in its dry saturated vapor state and dryness of 1 with which the temperature of the refrigerant vapor at the vapor side outlet of the heat exchanger is at the condensation temperature in the condenser, is expressed by $Xh \leqq X \leqq 1$.

4. A method of controlling a vapor compression refrigerating cycle apparatus comprising a compressor, a condenser, a regeneration heat exchanger, an expansion device, and an evaporator connected in series, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, the method comprising the steps of:

substituting process part occurring in a superheated vapor zone of the isothermal heat dissipation process in the reversed Ericsson cycle by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition;

executing part of the isobaric heat dissipation process in the liquid zone in the regeneration heat exchanger by releasing heat from refrigerant liquid in the liquid zone to refrigerant vapor entering the compressor;

substituting remaining process part of the isobaric heat dissipation process in the liquid zone with isenthalpic or isentropic expansion, the expansion being carried out by the expansion device, and introducing expanded refrigerant to the evaporator to carry out isothermal and isobaric heat absorption and then to be sucked into the compressor; and controlling refrigerating capacity by controlling dryness of refrigerant vapor entering the vapor side of the regeneration heat exchanger, wherein dryness X of refrigerant vapor at a vapor side inlet of the regeneration heat exchanger is controlled so that temperature of refrigerant at the vapor side outlet of the regeneration heat exchanger is maintained near the condensing temperature in the condenser and a liquid side outlet temperature of the regeneration heat exchanger is maintained near the evaporation temperature in the evaporator.

5. A method of controlling a vapor compression refrigerating cycle apparatus comprising a compressor, a condenser, a regeneration heat exchanger, an expansion device, and an evaporator connected in series, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, the method comprising the steps of:

substituting process part occurring in a superheated vapor zone of the isothermal heat dissipation process in the reversed Ericsson cycle by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition;

executing part of the isobaric heat dissipation process in the liquid zone in the regeneration heat exchanger by releasing heat from refrigerant liquid in the liquid zone to refrigerant vapor entering the compressor;

substituting remaining process part of the isobaric heat dissipation process in the liquid zone with isenthalpic or isentropic expansion, the expansion being carried out by the expansion device, and introducing expanded refrigerant to the evaporator to carry out isothermal and isobaric heat absorption and then to be sucked into the compressor; and controlling refrigerating capacity by controlling dryness of refrigerant vapor entering the vapor side of the regeneration heat exchanger, detecting inlet and outlet temperatures of the vapor side and the liquid side of the regeneration heat exchanger;

controlling a flow rate of high-pressure liquid refrigerant passing through the expansion device to increase the flow rate when the liquid side outlet temperature is higher than the vapor side inlet temperature in the regeneration heat exchanger, and to decrease the flow rate when the liquid side inlet temperature is higher than the vapor side outlet temperature in the regeneration heat exchanger, to maintain each of temperature differences between a lower temperature side and a higher temperature side of the heat exchanger within a prescribed value.

6. A vapor compression refrigerating cycle apparatus comprising:

a compressor, a condenser, a regeneration heat exchanger, an expansion device, and an evaporator connected in series;

an injection device that injects liquid refrigerant; and a controller that controls refrigerating capacity, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, wherein process part occurring in a superheated vapor zone of the isothermal heat dissipation process in the reversed Ericsson cycle is substituted by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition, wherein part of the isobaric heat dissipation process in the liquid zone is carried out in the regeneration heat exchanger by releasing heat from refrigerant liquid in the liquid zone to refrigerant vapor entering the compressor, wherein remaining process part of the isobaric heat dissipation process in the liquid zone is substituted by isenthalpic or isentropic expansion, the expansion being carried out by the expansion device, and expanded refrigerant is introduced to the evaporator to carry out isothermal and isobaric heat absorption and then to be sucked into the compressor, wherein the regeneration heat exchanger is located so that its vapor side is between the evaporator and the compressor, and its liquid side is between the condenser and the expansion device, wherein the controller controls the refrigerating capacity by controlling dryness of refrigerant vapor entering the vapor side of the regeneration heat exchanger, and wherein a vapor side heat transfer path in the regeneration heat exchanger is diverted from the path at a midway along the path via a flow rate regulation valve, the vapor side heat transfer path allowing the diverted refrigerant vapor to flow into a cooling-load device, and allowing the refrigerant vapor flowing out from the cooling-load device and the refrigerant flowing out from the outlet of the regeneration heat exchanger to be introduced into the compressor.

7. A vapor compression refrigerating cycle apparatus comprising:

a compressor, a condenser, a regeneration heat exchanger, an expansion device, and an evaporator connected in series;

an injection device that injects liquid refrigerant; and a controller that controls refrigerating capacity, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, wherein process part occurring in a superheated vapor zone of the isothermal heat dissipation process in the reversed Ericsson cycle is substituted by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition, wherein part of the isobaric heat dissipation process in the liquid zone is carried out in the regeneration heat exchanger by releasing heat from refrigerant liquid in the liquid zone to refrigerant vapor entering the compressor, wherein remaining process part of the isobaric heat dissipation process in the liquid zone is substituted by isenthalpic or isentropic expansion, the expansion being carried out by the expansion device, and expanded refrigerant is introduced to the evaporator to carry out isothermal and isobaric heat absorption and then to be sucked into the compressor, wherein the regeneration heat exchanger is located so that its vapor side is between the evaporator and the compressor, and its liquid side is between the condenser and the expansion device, wherein the controller controls the refrigerating capacity by controlling dryness of refrigerant vapor entering the vapor side of the regeneration heat exchanger, and wherein a vapor side heat transfer path in the regeneration heat exchanger is diverted from the path at a midway along the path via a flow regulation valve, the vapor side heat transfer path allowing the refrigerant vapor flowing out from a cooling-load device to be introduced to a midway along the vapor side heat transfer path in the regeneration heat exchanger or to the outlet of the regeneration heat exchanger.

8. A vapor compression refrigerating cycle apparatus comprising:

a compressor, a condenser, a regeneration heat exchanger, an expansion device, and an evaporator connected in series;

an injection device that injects liquid refrigerant; and a controller that controls refrigerating capacity, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, wherein a process part occurring in a superheated vapor zone of the isothermal heat dissipation process in the reversed Ericsson cycle is substituted by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition, wherein part of the isobaric heat dissipation process in the liquid zone is carried out in the regeneration heat exchanger by releasing heat from refrigerant liquid in the liquid zone to refrigerant vapor entering the compressor, wherein remaining process part of the isobaric heat dissipation process in the liquid zone is substituted by isenthalpic or isentropic expansion, the expansion being carried out by the expansion device, and expanded refrigerant is introduced to the evaporator to carry out isothermal and isobaric heat absorption and then to be sucked into the compressor, wherein the regeneration heat exchanger is located so that its vapor side is between the evaporator and the compressor, and its liquid side is between the condenser and the expansion device, wherein the controller controls the refrigerating capacity by controlling dryness of refrigerant vapor entering the vapor side of the regeneration heat exchanger, and wherein a vapor side heat transfer path in the regeneration heat exchanger is diverted from the path at a midway along the path via a flow rate regulation valve, the vapor side heat transfer path allowing the refrigerant vapor flowing out from the cooling-load device to be returned to the vapor side heat transfer path at a position downstream from the midway position from where refrigerant is diverted.

9. The vapor compression refrigerating cycle apparatus according to any one of claim 6-8, wherein the controller controls the flow regulation valve so that dryness X of refrigerant vapor at a vapor side inlet of the heat exchanger is controlled to be in a range between Xh with which the state of the refrigerant vapor at the vapor side outlet of the heat exchanger is in its dry saturated vapor state and dryness of 1 with which the temperature of the refrigerant vapor at the vapor side outlet of the heat exchanger is at the condensation temperature in the condenser, that is expressed by $Xh \leqq X \leqq 1$.

10. The vapor compression refrigerating cycle apparatus according to claim 9, wherein the controller controls so that dryness X of refrigerant vapor at a vapor side inlet of the regeneration heat exchanger so that temperature of refrigerant at the vapor side outlet of the regeneration heat exchanger is maintained near a condensing temperature in the condenser and a liquid side outlet temperature of the regeneration heat exchanger is maintained near an evaporation temperature in the evaporator.

11. A vapor compression refrigerating cycle apparatus comprising:

a compressor, a condenser, a regeneration heat exchanger, an expansion device, and an evaporator connected in series;

an injection device that injects liquid refrigerant; and a controller that controls refrigerating capacity, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, wherein a process part occurring in a superheated vapor zone of the isothermal heat dissipation process in the reversed Ericsson cycle is substituted by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition, wherein part of the isobaric heat dissipation process in the liquid zone is carried out in the regeneration heat exchanger by releasing heat from refrigerant liquid in the liquid zone to refrigerant vapor entering the compressor, wherein remaining process part of the isobaric heat dissipation process in the liquid zone is substituted by isenthalpic or isentropic expansion, the expansion being carried out by the expansion device, and expanded refrigerant is introduced to the evaporator to carry out isothermal and isobaric heat absorption and then to be sucked into the compressor, wherein the regeneration heat exchanger is located so that its vapor side is between the evaporator and the compressor, and its liquid side is between the condenser and the expansion device, wherein the controller controls the refrigerating capacity by controlling dryness of refrigerant vapor entering the vapor side of the regeneration heat exchanger, and wherein the controller controls dryness X of refrigerant vapor at a vapor side inlet of the heat exchanger to be in a range between Xh with which the state of the refrigerant vapor at the vapor side outlet of the heat exchanger is in its dry saturated vapor state and dryness of 1 with which the temperature of the refrigerant vapor at the vapor side outlet of the heat exchanger is at the condensation temperature in the condenser, that is expressed by $Xh \leqq X \leqq 1$.

12. A vapor compression refrigerating cycle apparatus comprising:

a compressor, a condenser, a regeneration heat exchanger, an expansion device, and an evaporator connected in series;

an injection device that injects liquid refrigerant; and a controller that controls refrigerating capacity, wherein the vapor compression refrigerating cycle apparatus carries out a cycle corresponding to a reversed Ericsson cycle in which isothermal heat dissipation process and isothermal heat absorption process occur overstriding a saturated vapor line and a saturated liquid line respectively, and heat exchange is carried out between isobaric heat dissipation process in a liquid zone and isobaric heat absorption process in a superheated vapor zone, wherein a process part occurring in a superheated vapor zone of the isothermal heat dissipation process in the reversed Ericsson cycle is substituted by adiabatic compression process and isobaric heat dissipation process, the adiabatic compression being carried out by the compressor and the isobaric heat dissipation being carried out in the condenser together with remaining process part occurring in the superheated vapor zone of the isothermal heat dissipation process under isothermal and isobaric condition, wherein part of the isobaric heat dissipation process in the liquid zone is carried out in the regeneration heat exchanger by releasing heat from refrigerant liquid in the liquid zone to refrigerant vapor entering the compressor, wherein remaining process part of the isobaric heat dissipation process in the liquid zone is substituted by isenthalpic or isentropic expansion, the expansion being carried out by the expansion device, and expanded refrigerant is introduced to the evaporator to carry out isothermal and isobaric heat absorption and then to be sucked into the compressor, wherein the regeneration heat exchanger is located so that its vapor side is between the evaporator and the compressor, and its liquid side is between the condenser and the expansion device, wherein the controller controls the refrigerating capacity by controlling dryness of refrigerant vapor entering the vapor side of the regeneration heat exchanger, and wherein the controller controls dryness X of refrigerant vapor at a vapor side inlet of the regeneration heat exchanger so that temperature of refrigerant at the vapor side outlet of the regeneration heat exchanger is maintained near a condensing temperature in the condenser and a liquid side outlet temperature of the regeneration heat exchanger is maintained near an evaporation temperature in the evaporator.

* * * * *